US007642026B2

(12) United States Patent
Tada et al.

(10) Patent No.: US 7,642,026 B2
(45) **Date of Patent: *Jan. 5, 2010**

(54) ELECTROPHOTOGRAPHIC PHOTORECEPTOR, METHOD OF PRODUCING THE SAME, PROCESS CARTRIDGE, AND IMAGE-FORMING APPARATUS

(75) Inventors: Kazuyuki Tada, Kanagawa (JP); Tomotake Inagaki, Kanagawa (JP); Masaru Agatsuma, Kanagawa (JP); Tomomasa Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

This patent is subject to a terminal disclaimer.

(21) Appl. No.: 11/730,492

(22) Filed: Apr. 2, 2007

(65) Prior Publication Data

US 2008/0070135 A1 Mar. 20, 2008

(30) Foreign Application Priority Data

Sep. 20, 2006 (JP) ..... 2006-254761

(51) Int. Cl.
*G03G 15/02* (2006.01)

(52) U.S. Cl. ..... 430/57.1; 399/133

(58) Field of Classification Search ..... 430/57.1; 399/133

See application file for complete search history.

(56) References Cited

U.S. PATENT DOCUMENTS 7,316,876 B2 * 1/2008 Kobayashi ..... 430/60
2008/0014530 A1 * 1/2008 Kawamura ..... 430/270.1

FOREIGN PATENT DOCUMENTS

| | | | |
|---|---|---|---|
| JP | A-47-030330 | * | 11/1972 |
| JP | A 61-151665 | | 7/1986 |
| JP | A 04-130433 | | 5/1992 |
| JP | A-04-189873 | * | 7/1992 |
| JP | A-05-019500 | * | 1/1993 |
| JP | A-05-043813 | * | 2/1993 |
| JP | A-05-098181 | * | 4/1993 |
| JP | A-05-140472 | * | 6/1993 |
| JP | A-05-140473 | * | 6/1993 |
| JP | A-05-263007 | * | 10/1993 |
| JP | A-05-279591 | * | 10/1993 |
| JP | A-08-044088 | * | 2/1996 |
| JP | A-08-095430 | * | 4/1996 |
| JP | A-08-176293 | * | 7/1996 |
| JP | A-08-208820 | * | 8/1996 |
| JP | A-09-265195 | * | 10/1997 |
| JP | A 2002-174910 | | 6/2002 |
| JP | A-2004-029134 | * | 1/2004 |

* cited by examiner

*Primary Examiner*—John L Goodrow
(74) *Attorney, Agent, or Firm*—Oliff & Berridge, PLC

(57) ABSTRACT

The invention provides an electrophotographic photoreceptor that includes a cylindrical support, and a charge-generating layer and a charge-transporting layer on the cylindrical support, wherein a content per unit volume of a charge-generating material in the charge-generating layer increases from a center portion in an axial direction of the cylindrical support towards both end portions thereof, and a thickness of the charge-generating layer in an axial direction of the cylindrical support is 95% or more and 105% or less relative to an average thickness of the charge-generating layer.

15 Claims, 21 Drawing Sheets

ELECTROPHOTOGRAPHIC PHOTORECEPTOR, METHOD OF PRODUCING THE SAME, PROCESS CARTRIDGE, AND IMAGE-FORMING APPARATUS

CROSS-REFERENCE TO RELATED APPLICATION

This application is based on and claims priority under 35 USC 119 from Japanese Patent Application No. 2006-254761 filed Sep. 20, 2006.

BACKGROUND

1. Technical Field

The present invention relates to an electrophotographic photoreceptor, a method of producing the same, a process cartridge provided with the electrophotographic photoreceptor, and an image-forming apparatus.

2. Related Art

Digitalization of copiers and printers using an electrophotographic system has been advancing in recent years, and among these, those using a laser as an optical recording system are prevailing. Usually, a latent image is written by spot-scanning laser light in the axial direction of a photoreceptor with a laser scanning writing apparatus. Owing to cost reduction and miniaturization of polygon scanners, laser beam printers using an electrophotographic system have come to be used for personal use, but further cost reduction and miniaturization are essential for competing with printers using an inkjet method with which laser beam printers compete in the field of small printers.

SUMMARY

According to a first aspect of the invention, there is provided an electrophotographic photoreceptor having a cylindrical support, and a charge-generating layer and a charge-transporting layer on the cylindrical support, a content per unit volume of a charge-generating material in the charge-generating layer increasing from a center portion in an axial direction of the cylindrical support towards both end portions thereof, and thicknesses of the charge-generating layer along the axial direction of the cylindrical support being within a range of from 95% to 105% with regard to an average thickness of the charge-generating layer.

BRIEF DESCRIPTION OF THE DRAWINGS

Exemplary embodiments of the present invention will be described in detail based on the following figures, wherein.

DETAILED DESCRIPTION

The present invention will be described in detail below. In the present specification " . . . to . . . " represents a range including the numeral values represented before and after "to" as a minimum value and a maximum value, respectively.

Figure 1:
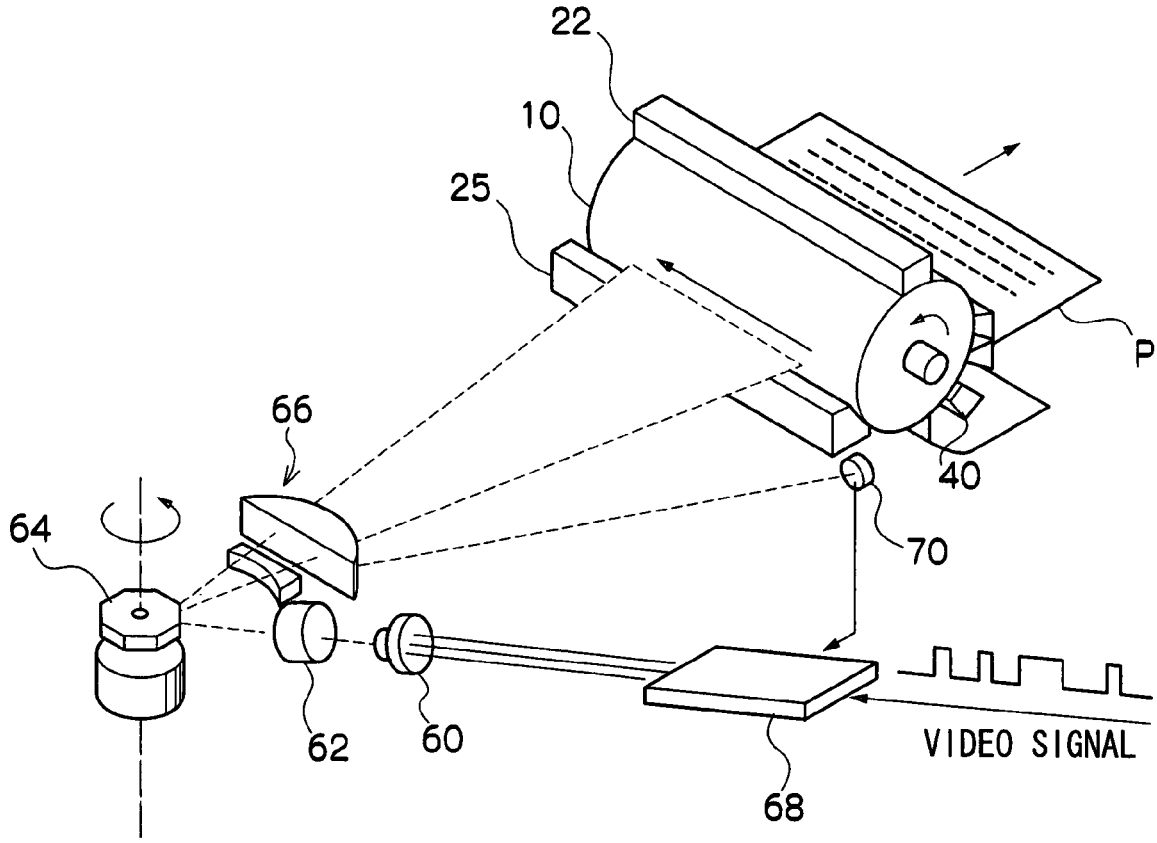
FIG. 1 is an illustration showing the structure of a laser scanning wiring device.

An electrophotographic photoreceptor in an exemplary embodiment of the invention (hereinafter, in some cases, referred to as "photoreceptor") includes: a cylindrical support; and, on the cylindrical support, a charge-generating layer and a charge-transporting layer, wherein a content per unit volume of a charge-generating material in the charge-generating layer increases from a center portion in an axial direction of the cylindrical support towards both end portions thereof, and thicknesses of the charge-generating layer along the axial direction of the cylindrical support are within a range of from 95% to 105% with regard to an average thickness of the charge-generating layer As shown in FIG. 1, the image-forming apparatus in the exemplary embodiment of the present invention comprises an electrophotographic photoreceptor 10, a charger 22 that charges the electrophotographic photoreceptor 10, a tent image formation unit (an exposure unit) that forms a latent image on the charged electrophotographic photoreceptor, a developer 25 for developing the latent image by a toner, and a transfer unit 40 that transfers the toner image onto a recording medium, thereby forming an image on transfer medium P.

One example of the constitution of a laser scanning writing device used as an exposure unit is shown in FIG. 1. The laser scanning writing device has a semiconductor laser 60 that generates a luminous flux (laser beam), a collimating lens 62 arranged on the light axis of the semiconductor laser 60 to collimate the laser beam, a polygon mirror 64 that scans and polarizes the laser beam, and an fθ lens 66 that condenses the laser beam polarized by the polygon mirror 64.

In the laser scanning writing device described above, the semiconductor laser 60 is driven by a laser driving part 68 in response to an image information signal, whereby a laser beam processed by collimation by the collimating lens 62 is output by a light source device depending on the image information. The laser beam is polarized by the polygon mirror 64. When an image is formed by main scanning, the position of light beam is detected with a scanning starting position sensor 70, thereby synchronizing the main scanning.

The polarized laser beam is condensed by the fθ lens 66 to form an image on the photoreceptor 10 serving as a surface scanned with the laser beam.

The fθ lens 66 is compensated such that the scanning speed becomes constant on the photoreceptor 10. A latent image corresponding to the image information is thereby formed on the photoreceptor 10.

Figure 2:
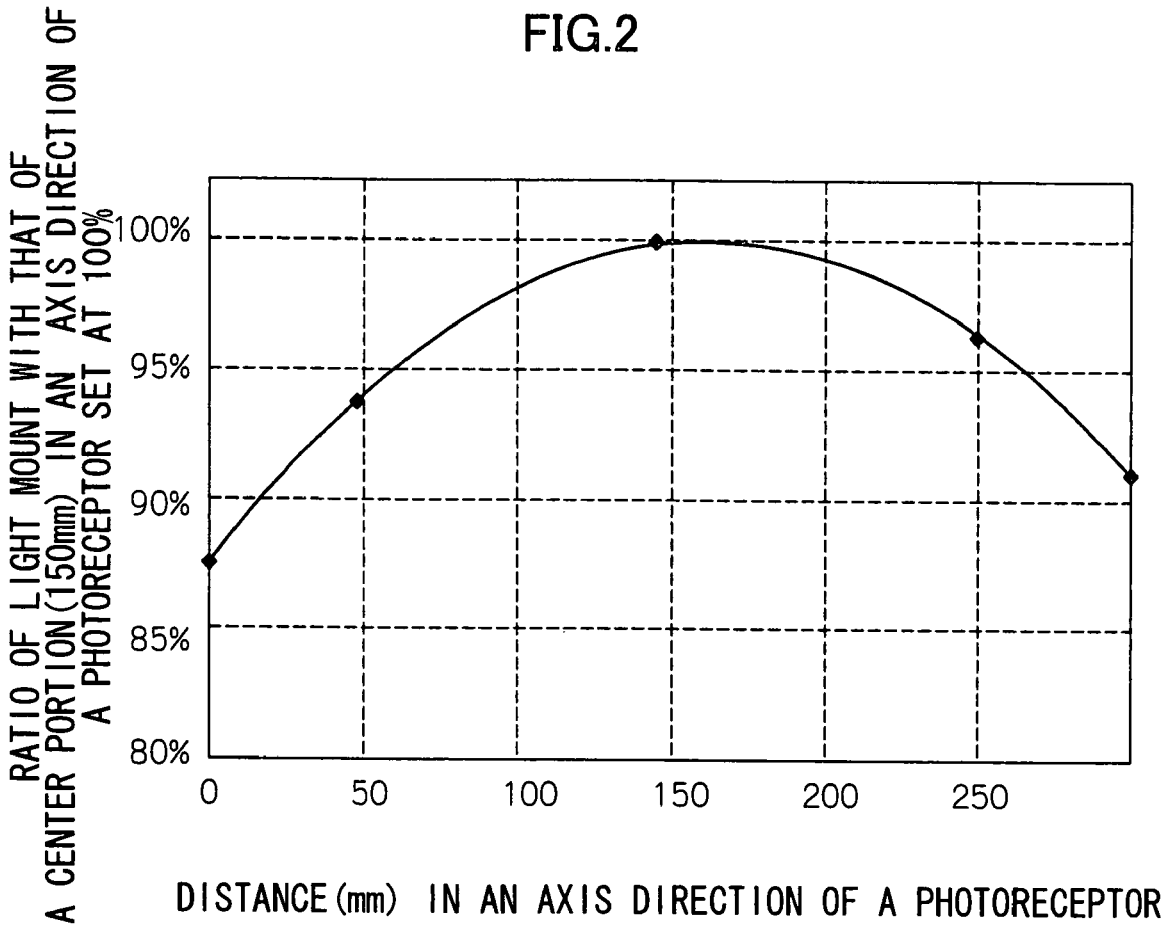
FIG. 2 is a graph showing one example of light quantity distribution in the axial direction of a photoreceptor.

Since the light quantity distribution of the laser beam has a Gaussian distribution around the center, as the scanning angle of the polygon mirror relative to the light axis of incident light is increased, the light quantity is the highest at the central portion in the axial direction of the photoreceptor, and the light quantity is decreased in the directions toward both end sides, as shown in FIG. 2, and the distribution of light quantity influences the sensitivity distribution in the axial direction of the photoreceptor.

For compensation of the distribution of light quantity in the axial direction of the photoreceptor, a method of regulating the optical system or of inserting a correction filter is adopted, but the constitution of the latent image formation unit is complicated, and the regulation operation is also complicated.

To compensate the distribution of light quantity in the axial direction of the photoreceptor by photoreceptor itself, such thickness profile of charge-generating layer is sometimes used that the thickness of the layer is thicker toward both ends. However, such thickness profile may cause "ghost" in print image. The thicker layer is likely to be cause of positive ghost.

In this connection, in an electrophotographic photoreceptor of the invention, thicknesses of the charge-generating layer along the axial direction are set to within a range of from 95% to 105% with regard to an average thickness of the charge-generating layer.

The ghost in the exemplary embodiment means a phenomenon where an exposure hysteresis (exposed image) of a previous cycle remains in a subsequent cycle where printing and exposure are carried out. A case where the previous hysteresis appears denser than a reference image density relative to a printed image is called a positive ghost and a case where the previous hysteresis appears fainter than the reference image density is called a negative ghost. In both cases, the ghost appears conspicuously on a halftone image. Normally, for the ghost, a sensory evaluation where a printed image is compared with an image that is a reference is carried out.

Hereinafter, the charge-generating layer and the method of producing thereof are first described, and then the electrophotographic photoreceptor having the charge-generating layer is descried and further the process cartridge provided with the electrophotographic photoreceptor, and the image-forming apparatus, are described.

<Charge-generating Layer>

The charge-generating layer contains at least a charge-generating material and a resin.

The charge-generating materials used include those known in the art, for example azo pigments such as bisazo and trisazo; condensed ring aromatic pigments such as dibromoanthanthrone; organic pigments such as perylene pigment, pyrroropyrrole pigment and phthalocyanine pigment; and inorganic pigments such as triclinic selenium and zinc oxide. In particularly, metal or nonmetal phthalocyanine pigments, triclinic selenium, and dibromoanthanthrone are preferable.

Particularly preferable among these are hydroxy gallium phthalocyanine disclosed in JP-A Nos. 5-263007 and 5-279591, chlorogallium phthalocyanine in JP-A No. 5-98181, dichlorotin phthalocyanine in JP-A Nos. 5-140472 and 5-140473, and titanyl phthalocyanine in JP-A Nos. 4-189873 and 5-43813.

The resin may be selected from a wide variety of resins, and preferable resins include, but are not limited to, polyvinyl butyral resin, polyarylate resin (polycondensate product of bisphenol A and phthalic acid, etc.), polycarbonate resin, polyester resin, phenoxy resin, vinyl chloride-vinyl acetate copolymer, polyamide resin, acryl resin, polyacrylamide resin, polyvinyl pyridine resin, cellulose resin, urethane resin, epoxy resin, casein, polyvinyl alcohol resin and polyvinyl pyrrolidone resin.

These resins may be used alone or in combination of two or more thereof. A material having both the function of the resin and the function of the charge-generating material, such as poly-N-vinyl carbazole, polyvinyl anthracene, polyvinyl pyrene and polysilane, may also be used.

The compounding ratio (weight ratio) of the charge-generating material to the resin is preferably in a range of 10:1 to 1:10 (=charge-generating material:resin). As the method of dispersing them, usual methods such as a ball mill dispersion method, an atrighter dispersion method or a sand mill dispersion method may be used.

In dispersion, it is effective for the size of the particle to be reduced to a size of 0.5 μm or less, preferably 0.3 μm or less, more preferably 0.15 μm or less. As the solvent used in dispersion, an usual organic solvent such as methanol, ethanol, n-propanol, n-butanol, benzyl alcohol, methyl Cellosolve, ethyl Cellosolve, acetone, methyl ethyl ketone, cyclohexanone, methyl acetate, n-butyl acetate, dioxane, tetrahydrofuran, methylene chloride, chloroform, chlorobenzene and toluene may be used. These solvents may be used alone or in combination of two or more thereof.

In a charge-generating layer of the exemplary embodiment, a content per unit volume of a charge-generating material increases from the center portion in an axial direction of a cylindrical support towards both end portions of the cylindrical support. When there is a tendency that a content per unit volume of a charge-generating material increases from the center portion towards both end portions, the content may temporarily decrease towards the end portions.

In the exemplary embodiment, the content per unit volume of a charge-generating material means a content measured by a light absorption method.

In the exemplary embodiment, as an illuminating light source, a halogen lamp is used. Light of the light source is guided by an optical fiber to a measurement position on a sample on which a charge-generating layer is formed, and a wavelength of the light is split every 10 nm by a spectrophotometer to measure light amount data thereof, followed by confirming an intensity of reflective light.

An intensity of light reflected at a wavelength portion of 750 nm with respect to the maximum intensity of light reflected in the visible light region (400 to 800 nm) is calculated as a spectral absorption ratio (=[intensity of light at a wavelength of 750 nm]/[the maximum light intensity in the visible region (400 to 800 nm)]).

Figure 3:
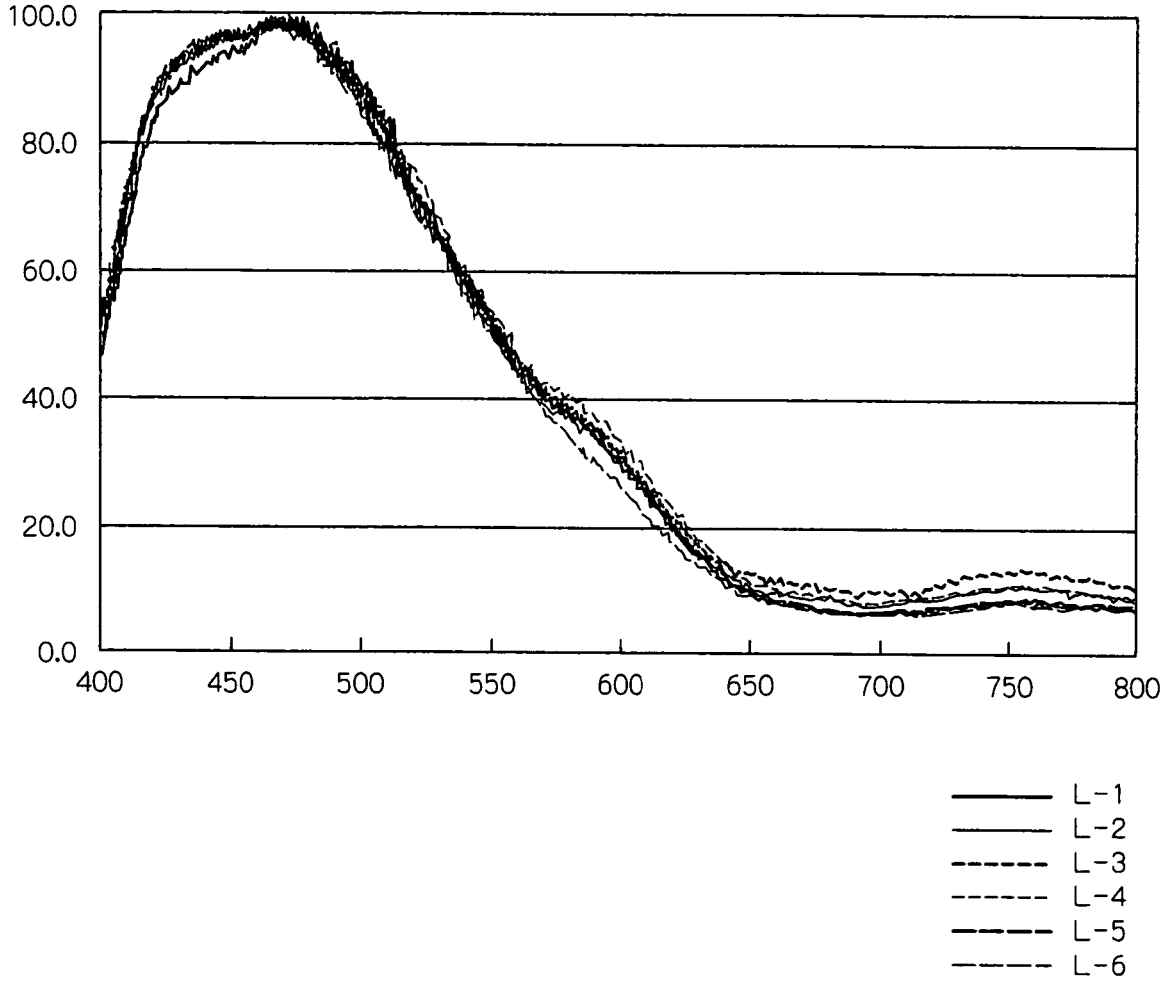
FIG. 3 is a diagram showing an example of intensity of light reflected from an electrophotographic photoreceptor.

FIG. 3 shows an example of an absorption spectrum of an electrophotographic photoreceptor. In the spectrum in FIG. 3, the maximum light intensity of reflected light is shown at a wavelength of 470 nm; accordingly, the spectral absorption ratio represents a ratio of light intensity of reflected light at a wavelength of 750 nm to light intensity of reflected light at a wavelength of 470 nm.

In FIG. 3, absorption spectra of charge-generating layers formed with coating solutions having different concentrations of a charge-generating material are shown. As the concentration of the charge-generating layer becomes higher, the light intensity at a wavelength of 750 nm becomes stronger. Accordingly, the spectral absorption ratio becomes lower as the concentration of the charge-generating layer becomes higher. In the invention, there is no need for obtaining a content per unit volume of the charge-generating material as an absolute value; accordingly, it may be confirmed that the content per unit volume of the charge-generating material varies in the axial direction by making reference to a value of the spectral absorption ratio. That is, in the exemplary embodiment, the spectral absorption ratio of a photoreceptor (spectral absorption ratio when measurement is carried out in a state where other layers such as a charge-transporting layer are included besides the charge-generating layer,) decreases from a center portion in the axial direction of the photoreceptor towards both of the end portions thereof.

Furthermore, correlation exists between the content of a charge-generating material and the spectral absorption ratio. Accordingly, as a relative value of the spectral absorption ratio, a spectral absorption ratio at an end portion with respect to a spectral absorption ratio at a center portion of the cylindrical support is obtained.

Figure 4A:
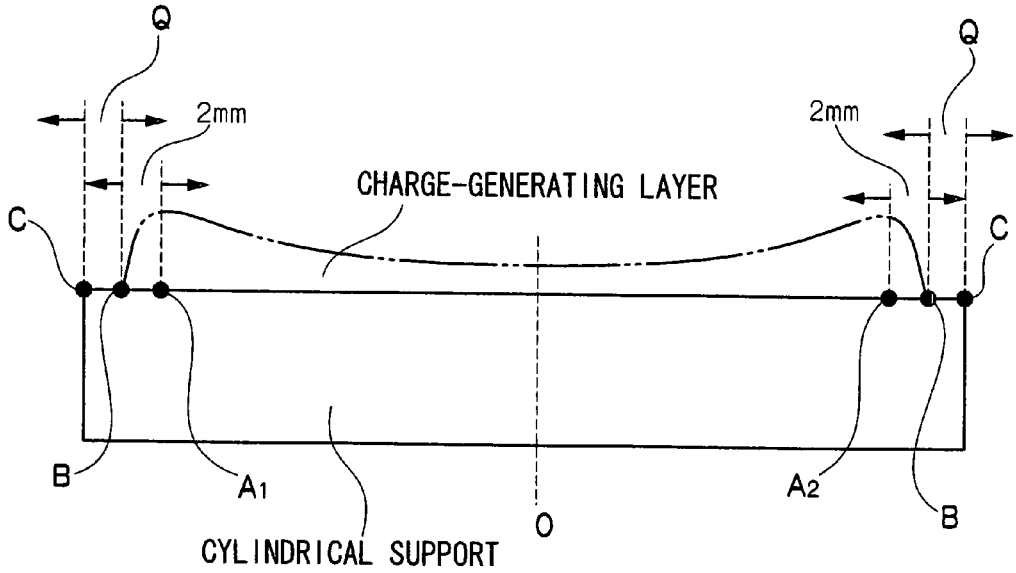
FIGS. 4A and 4B each shows an image diagram of a concentration gradient in a charge-generating layer that is an example of a calibration curve for thickness measurement by means of a light absorption method.
Figure 4B:
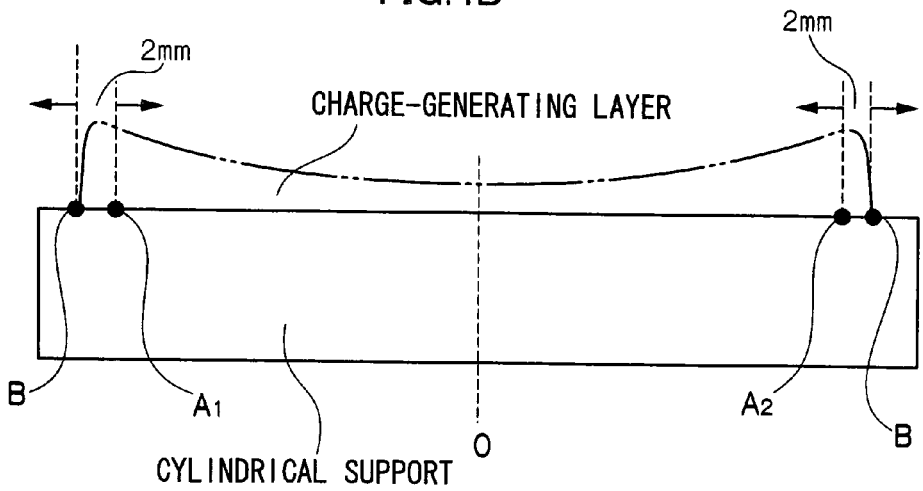

As used herein, the end portion refers to a portion that is 2 mm toward the central portion from the end of the charge-generating layer in the axial direction. This definition of the end portion applies hereinafter. For example, as shown in FIGS. 4A and 4B, the end portions are $A_1$ and $A_2$, and the end portions $A_1$ and $A_2$ are portions that is 2 mm toward the central portion from the end B in the axial direction.

The closer the end portion is to the end of the cylindrical support in the axial direction, the greater the region (effective region) where an image may be formed on the photoreceptor becomes and smaller an area where an image is not formed becomes, so that an image of equivalent size may be forming using a smaller image-forming apparatus. A length of an effective region is defined as the length of an image of constant quality in the axial direction of the photoreceptor and satisfying a standard of quality in each image-forming apparatus, and the effective region is a region wherein differences in image density in a printed image formed at 100% image density, with respect to an image density at a part corresponding to the central portion in the axial direction of the charge-generating layer, are within 0.25D.

The length of the effective region of a general photoreceptor is shown in Table 1 below. On the other hand, the length of the effective region of a photoreceptor in accordance with this exemplary embodiment is increased by suppressing occurrence of image density unevenness even in the end portions of the photoreceptor. Therefore, the percentage of the length of the effective region based on the length of the cylindrical support at the axial direction may be 92% or more, and even furthermore 95% or more.

TABLE 1

| | Image length (mm) | Photoreceptor length (mm) | Percentage of effective region (%) | Region which is not utilizable for image formation (mm) |
|---|---|---|---|---|
| A4 size | 210 | 235 | 89.36 | 25 |
| A3 size | 297 | 334 | 88.92 | 37 |

In each of FIGS. 4A and 4B, an image diagram of a concentration gradient of a charge-generating layer in a photoreceptor of the exemplary embodiment is shown. However, the charge-generating layer of the invention is not restricted to the concentration gradients shown in FIGS. 4A and 4B.

As shown in FIGS. 4A and 4B, a concentration becomes higher from a center portion O towards end portions $A_1$ and $A_2$ (a position located 2 mm towards the center portion from an axial direction end B where the charge-generating layer begins forming). The spectral absorption ratio becomes lower from the center portion O towards the end portions $A_1$ and $A_2$.

From the viewpoint of the necessity for a region for attaching a jig required for arranging the photoreceptor in an image-forming apparatus, an region Q at which the layer is not formed is preferably provided between the end B of the charge-generating layer and the end C of the cylindrical support. When the charge-generating layer and the charge-transporting layer are formed by dip coating, a formed coating extends to the end of the base material (the cylindrical support), and thus a coating formed on the jig-attaching region is wiped off.

Still furthermore, the thickness of a charge-generating layer of the exemplary embodiment is less fluctuated in an axial direction of a photoreceptor. That is, a thickness of the charge-generating layer along the axial direction is within range of from 95% to 105%, preferably within range of from 97.5% to 102.5%, and more preferably within range of from 98% to 102%, with regard to an average thickness of the charge-generating layer.

The thickness of a charge-generating layer is measured with a step meter after partially dissolving the charge-generating layer, or by observing with a SEM (scanning electron microscope) after cutting a section thereof. The following numerical range of the thickness means that it is expressed by a value measured by observing with a SEM.

The thickness of a charge-generating layer used in the exemplary embodiment is, by average, preferably from 0.1 μm to 5 μm, and more preferably from 0.2 μm to 2.0 μm.

An average thickness in the exemplary embodiment means an arithmetic average value of thicknesses obtained by measuring by means of the above-mentioned method in an axial direction of a cylindrical support. As measurement points, in each 3 point of positions $Z_1$ and $Z_2$ at an equidistance in a peripheral direction of a photoreceptor (6 points in total) and 3 points at an equidistance in a peripheral direction of a photoreceptor at a center portion in an axial direction of a photoreceptor of a charge-generating layer, that is, 9 points are taken in total.

In general, the thinner the thickness of the charge-generating layer becomes, the larger the fluctuation of the sensitivity becomes. In the exemplary embodiment, the sensitivity thereof may be inhibited from fluctuating even in a charge-generating layer thin in the thickness. Accordingly, even in a charge-generating layer having a thin film such thin as from 0.1 μm to 0.5 μm in the average thickness of the charge-generating layer, the fluctuation of the sensitivity may be confined within a practical range.

Furthermore, in a photoreceptor of the exemplary embodiment, the spectral absorption ratio at the end portion is preferably from 75% to 99%, more preferably from 75% to 95%, and still more preferably from 75% to 90% with regard to a spectral absorption ratio at the center portion in the axial direction.

A charge-generating layer of the exemplary embodiment has a concentration distribution as mentioned above; accordingly, it is preferred to form a film of the charge-generating layer by use of an inkjet method.

In a jetting system in the inkjet method, a general system such as a continuous or intermittent type (for example, piezoelectric, thermal or electrostatic type) may be used, among them, a piezoelectric continuous or intermittent type is preferable, and a piezoelectric intermittent type is more preferable.

FIGS. 5 to 9 show a scanning inkjet method, but the method of forming the charge-generating layer according to this exemplary embodiment is not limited thereto. The scanning type is a system of coating with droplets discharged from a scanning droplet discharge head scanned in parallel with the axis of the cylindrical support.

Figure 5:
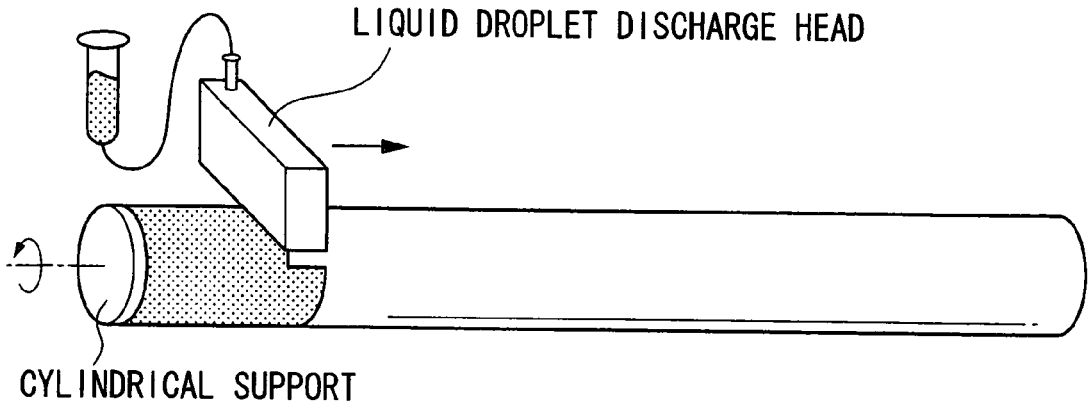
FIG. 5 is an illustration showing one example of an inkjet method using a droplet discharge head in a usual ink jet printer.

FIG. 5 shows one example of the inkjet method of using a droplet discharge head in a usual ink jet printer, and this liquid discharge head has the plural nozzles in the longitudinal direction. An easy-to-use syringe for supplying a liquid is shown in FIG. 5. When the axis of the cylindrical support is arranged horizontally, usually the cylindrical support is coated with droplets with rotating thereof. The resolution of jetting influencing the quality of a coating is determined by the scanning direction and the angle of nozzle array.

Figure 11:
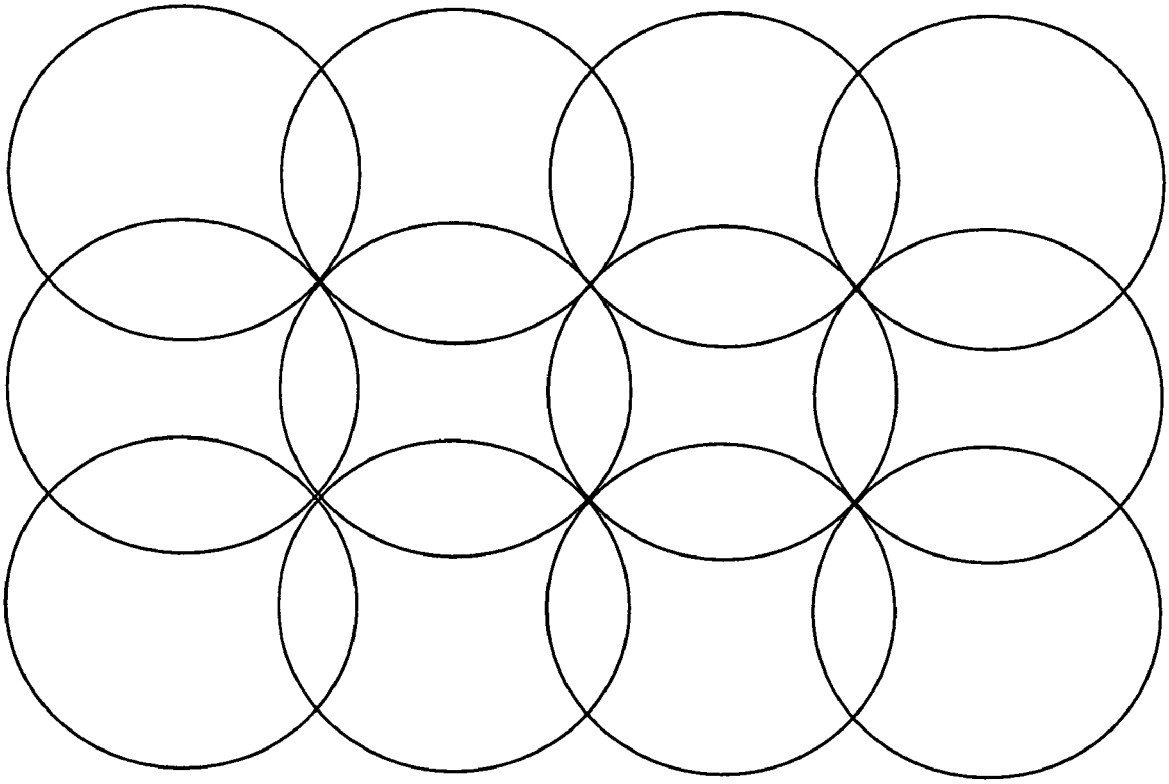
FIG. 11 is an illustration showing a state of applied droplets of a coating solution in an inkjet method.

As shown in FIG. 11, the resolution (number of pixels of a coating solution in 1 inch) of jetting of droplets is preferably regulated such that droplets, upon reaching the surface of an object, spread to contact with adjacent droplets to ultimately form a coating. Droplets may be applied in consideration of surface tension of the base material, spreading of droplets upon reaching the surface, the size of droplets upon jetting, and the evaporation speed of the coating solvent attributable to the concentration of the solvent and the type of the solvent. These conditions are determined and preferably regulated according to the type of the coating solution, the composition, and the physical properties of the material to be coated with droplets.

Figure 12A:
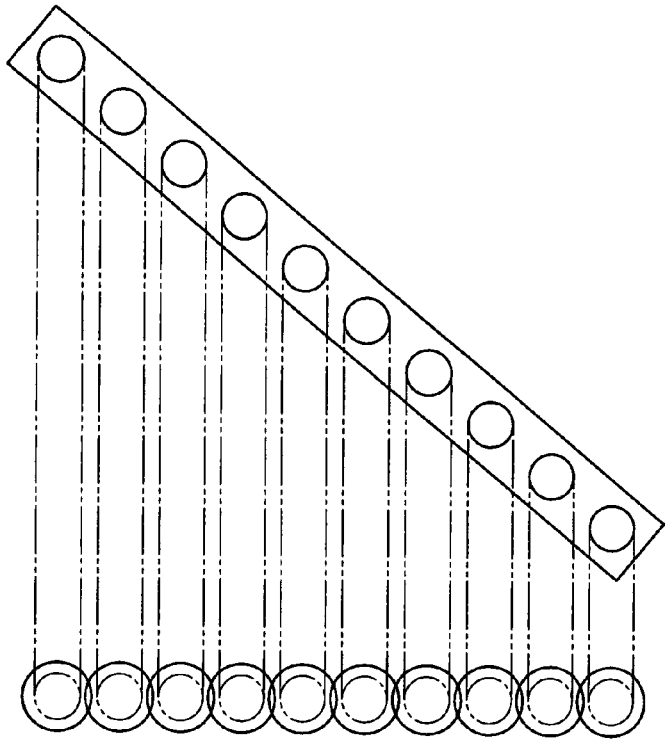
FIGS. 12A and 12B are an illustration showing a method so that an apparent resolution is improved in case of an inkjet method.
Figure 12B:
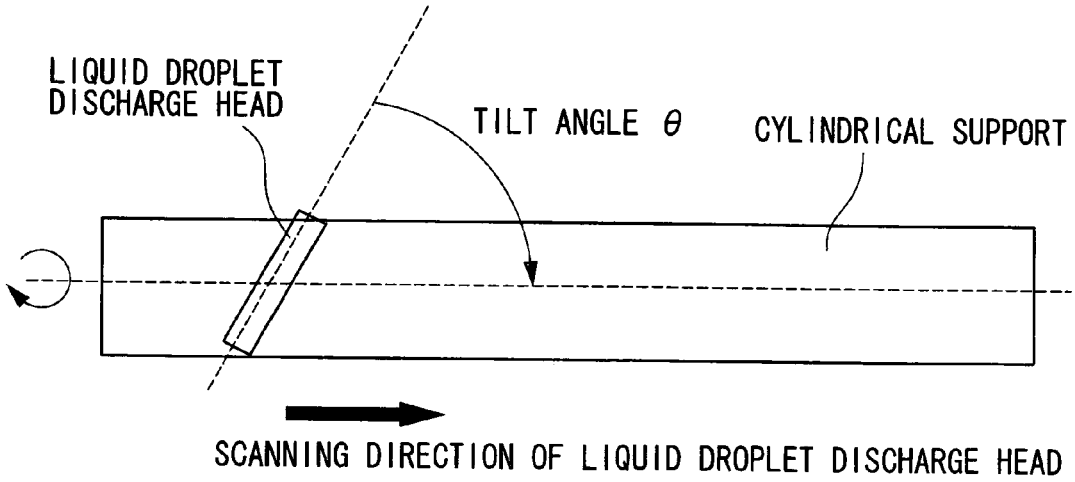

It is preferable that, in consideration of the distance between arranged nozzles, the droplet discharge head is arranged to be inclined relative to the axis of the photoreceptor as shown in FIG. 12A and FIG. 12B such that droplets after jetting from the nozzles and reaching the surface are contacted with adjacent droplets as shown in FIG. 11, thereby improving the apparent resolution. As shown in FIG. 12A, the diameter of droplets upon jetting is about the same as that of the nozzle, but upon reaching the surface of the photoreceptor A, the droplets spread as shown by the solid line thereby being contacted with adjacent droplets, to form a layer.

Figure 13:
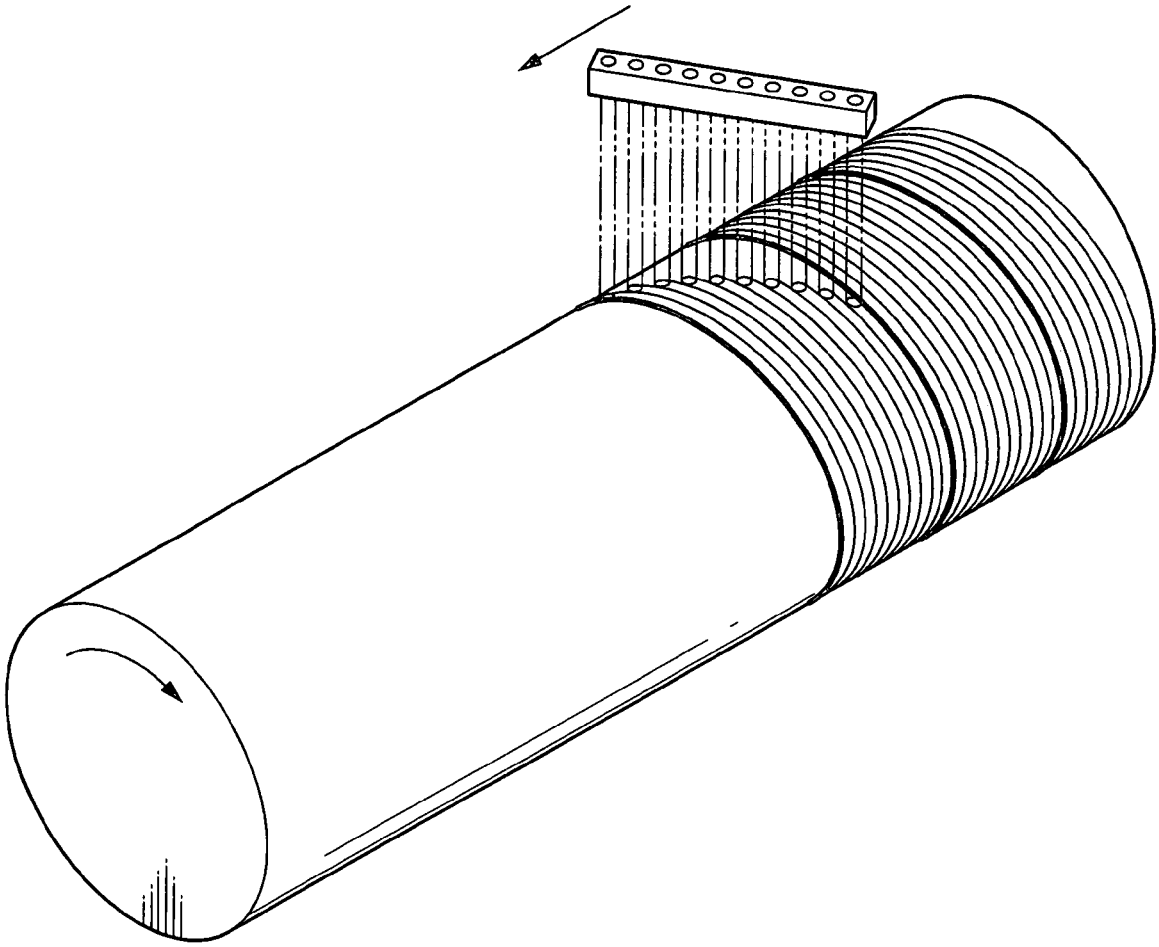
FIG. 13 is an illustration showing a method of forming a charge-generating layer by an inkjet method.

In this state, the cylindrical support is rotated and simultaneously a coating solution is jetted through the nozzles, and as shown in FIG. 13, the droplet discharge head is transferred horizontally from one end of the cylindrical support to the other end. The charge-generating layer may be further thickened by recoating.

Specifically, the cylindrical support is fit to a device capable of horizontally rotating, and the droplet discharge head charged with a charge-generating layer coating solution is arranged so as to jet droplets onto the cylindrical support. Because the object onto which droplets are jetted is a cylinder having a small diameter, nozzles through which the coating solution will not reach the cylinder are preferably closed, from the viewpoint of reducing the amount of waste liquid.

Here, a cylindrical coating base material is shown, but a flat coating base material may also be used if the base material and the droplet discharge head can be relatively moved.

Figure 6:
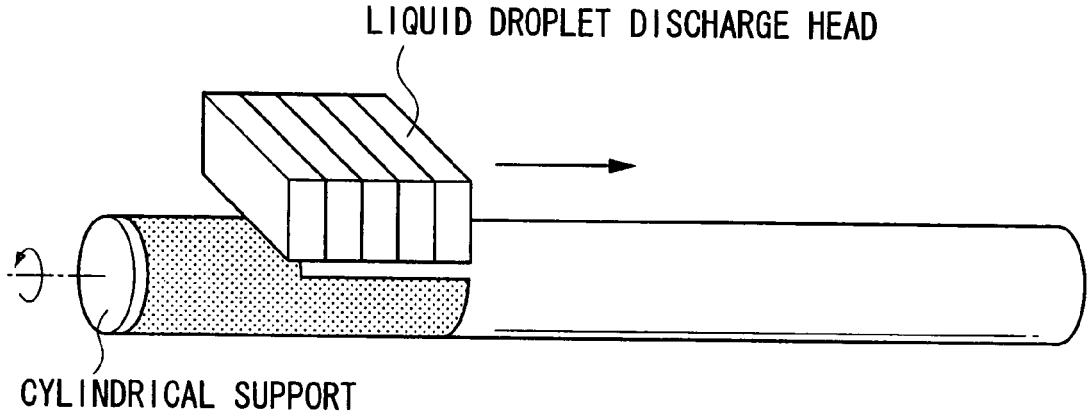
FIG. 6 is an illustration showing an example of an inkjet method in the case where two or more droplet discharge heads in FIG. 6 are arranged in a matrix.

FIG. 6 is one example of the inkjet method wherein two or more droplet discharge heads in FIG. 5 are arranged in a matrix. In this method, by selecting jetting nozzles and arranging nozzles that are different in size in the matrix, the amount of jetted droplets may be regulated.

Figure 7:
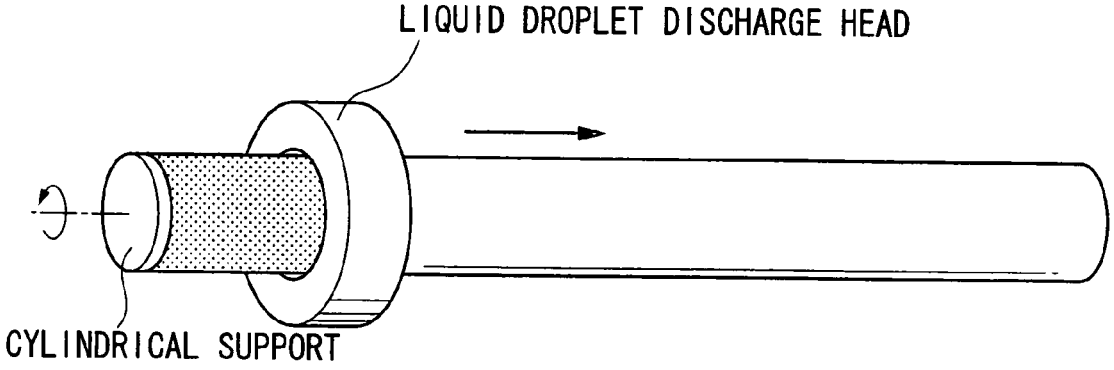
FIG. 7 is an example of an inkjet method by a liquid discharge head designed so as to surround the circumference of a cylindrical support.

FIG. 7 shows an example of a droplet discharge head designed so as to surround the circumference of a base material to be coated with droplets. Discharge nozzles are usually formed at constant intervals in the circumferential direction.

Figure 8:
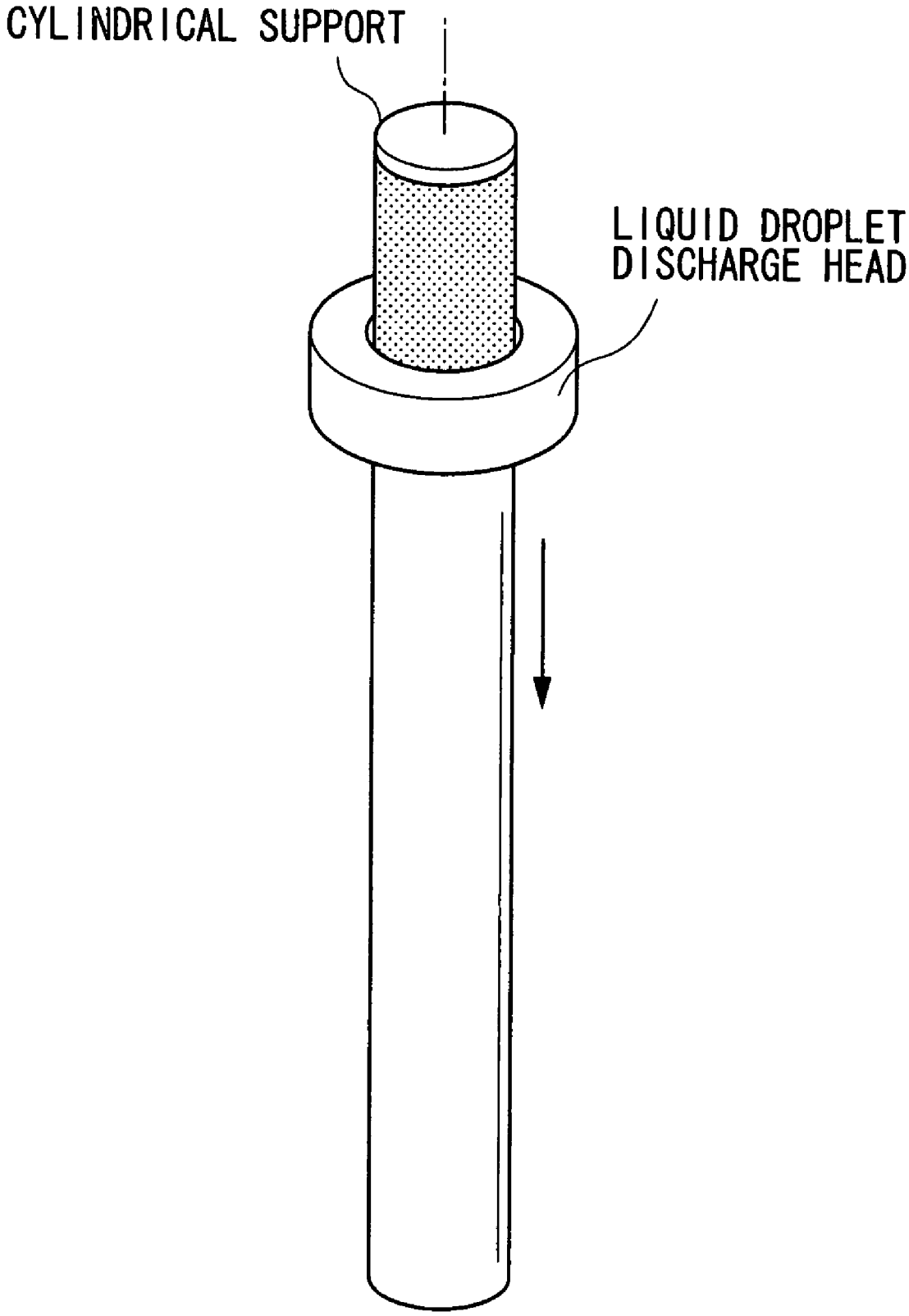
FIG. 8 is an example of an inkjet method in the case where the constitution of FIG. 8 is displaced in the vertical direction.

In FIG. 8, the configuration shown in FIG. 7 is arranged in the vertical direction. The vertical direction means not only 90° but also an angle deviated from 90°.

Figure 9:
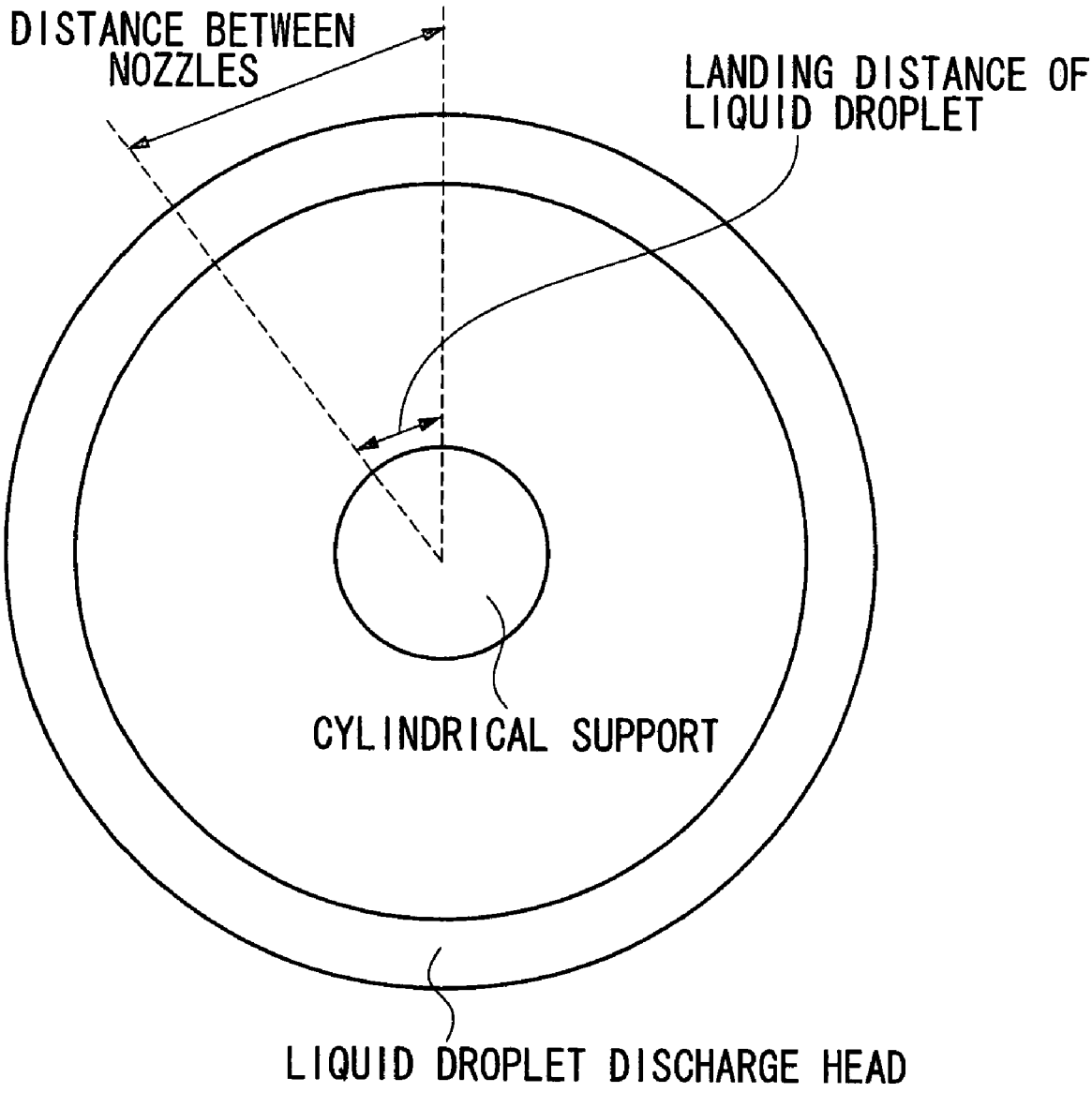
FIG. 9 is an illustration showing a cylindrical droplet discharge head.

In FIGS. 7 and 8, the diameter of the droplet discharge head may be increased to thereby decrease the distance between droplets reaching the surface of the base material and improve the resolution on the base material, as shown in FIG. 9.

Figure 10:
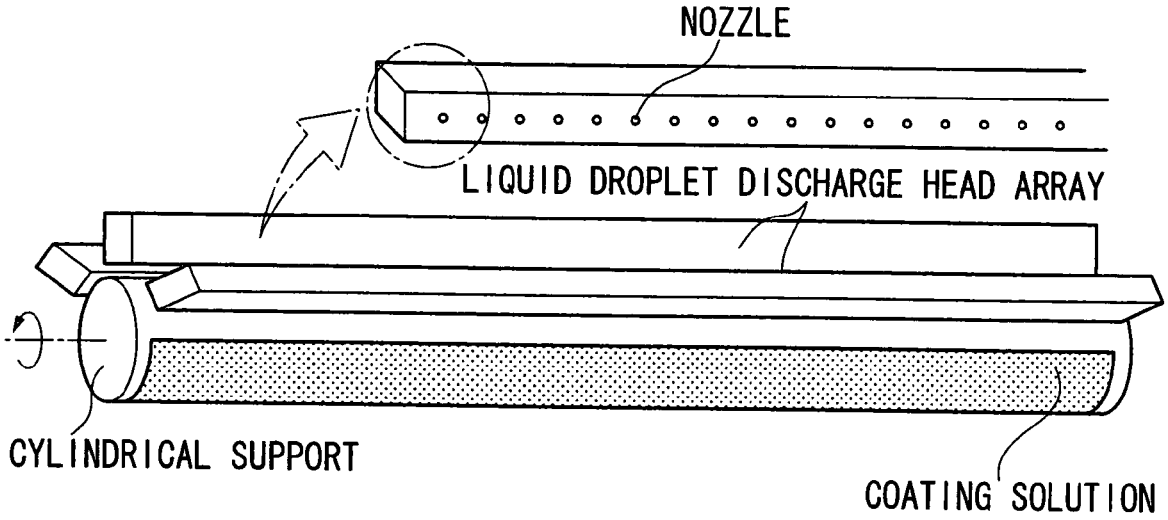
FIG. 10 is an illustration of an inkjet method in the case where a width of the droplet discharge head is equal to or longer than a length of a cylindrical support, and the droplet discharge head may coat the entire length of the cylindrical support at once.

FIG. 10 shows one example of an inkjet method wherein a droplet discharge head has a width that is equal to or greater than that of a cylindrical support, thereby coating the cylindrical support overall at once in the axial direction. If two or more droplet discharge heads may be used as shown in FIG. 10, high resolution may be attained. Even by the single droplet discharge head, continuous formation of a coating film is feasible by scanning in the axial direction in a minute distance to compensate for the distance between nozzles.

By use of the droplet discharge head, a coated film that has a concentration distribution of a charge-generating material at the end portions relative to an axis of a base material is formed.

In scanning types shown in FIGS. 5 through 8, with a plurality of droplet discharge heads prepared, the heads are scanned in an axial direction while varying discharge amounts per unit time of coating solutions having different concentrations of the charge-generating material from the respective heads to form a desired concentration distribution.

For instance, a droplet discharge head 1 that stores a coating solution 1 with a higher concentration of a charge-generating material and a droplet discharge head 2 that stores a coating solution 2 with a lower concentration than that of the coating solution 1 are prepared. The droplet discharge head 1 is controlled so that a discharge amount per unit time is larger at both of the end portions and smaller at the center portion, while the droplet discharge head 2 is controlled so that a discharge amount per unit time is smaller at both of the end portions and larger at the center portion, whereby a concentration distribution of the invention may be formed.

Furthermore, like in a commercially available printer, a continuous film may also be formed by scanning a head with respect to a motionless base material in an axial direction to discharge the coating solutions 1 and 2 in a desired pattern, followed by moving the base material by a certain angle, and scanning the head once more to carry out discharging again.

For example, when the continuous droplet discharge head is used, the direction along which droplets are discharged may be changed with a bias in an electric field such that some droplets will not reach the base material, particularly in a thin-film region at the central portion of the base material. Droplets not used in forming a coating film are recovered through a gutter.

In the case of a head of intermittent type, for instance, a head having a coating solution having higher concentration may be discharged at a higher discharge frequency at both of the end portions. Furthermore, a discharge amount may be increased by increasing a pulse voltage or increasing a pulse duration. Furthermore, a low concentration portion may be also formed by providing a nozzle that does not discharge ink by not applying a pulse.

For the intermittent ink jet droplet discharge head, a viscosity of a coating solution is preferably in a range of from 0.8 mPa·s to 20 mPa·s, and more preferably in a range of from 1 Pa·s to 10 mPa·s.

The viscosity in this exemplary embodiment refers to a value determined by an E-type viscometer (RE550L, standard cone rotor, revolution rate of 60 rpm, manufactured by Toki Sangyo Co., Ltd.) at 25° C.

The above-described charge-generating material, resin and other additives such as particles are preferably contained in solvent. Any ordinary organic solvent may be used, including, for example, methanol, ethanol, n-propanol, n-butanol, benzyl alcohol, methyl cellosolve, ethyl cellosolve, 3-hydroxy-3-methyl-2-butanone, diacetone alcohol, γ-ketobutanol, acetol, butyl carbitol, glycerin, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination of two or more thereof.

When a coating solution at high concentration, that is, a coating solution of high viscosity is used, the continuous ink jet droplet discharge head for pressurizing the coating solution is preferable. However, even an intermittent head may also be used for a highly viscous material by providing it with a heater to heat a coating solution used in a commercial bar coat printer to reduce viscosity at jetting portions.

The diameter of droplet to be jetted is preferably from 1 pl to 60 pl, more preferably from 1.5 pl to 55 pl, and still more preferably from 2.0 pl to 50 pl.

In this exemplary embodiment, the diameter of droplets is determined by off-line visualization evaluation. Droplets are lighted by LED in synchronization with jetting timing and their image is observed with a CCD camera.

The method of forming the layer by the ink jet method has been described by reference to the method of forming the charge-generating layer, but this ink jet method may also be used in formation of other layers such as a charge-transporting layer.

<Electrophotographic Photoreceptor>

Figure 14:
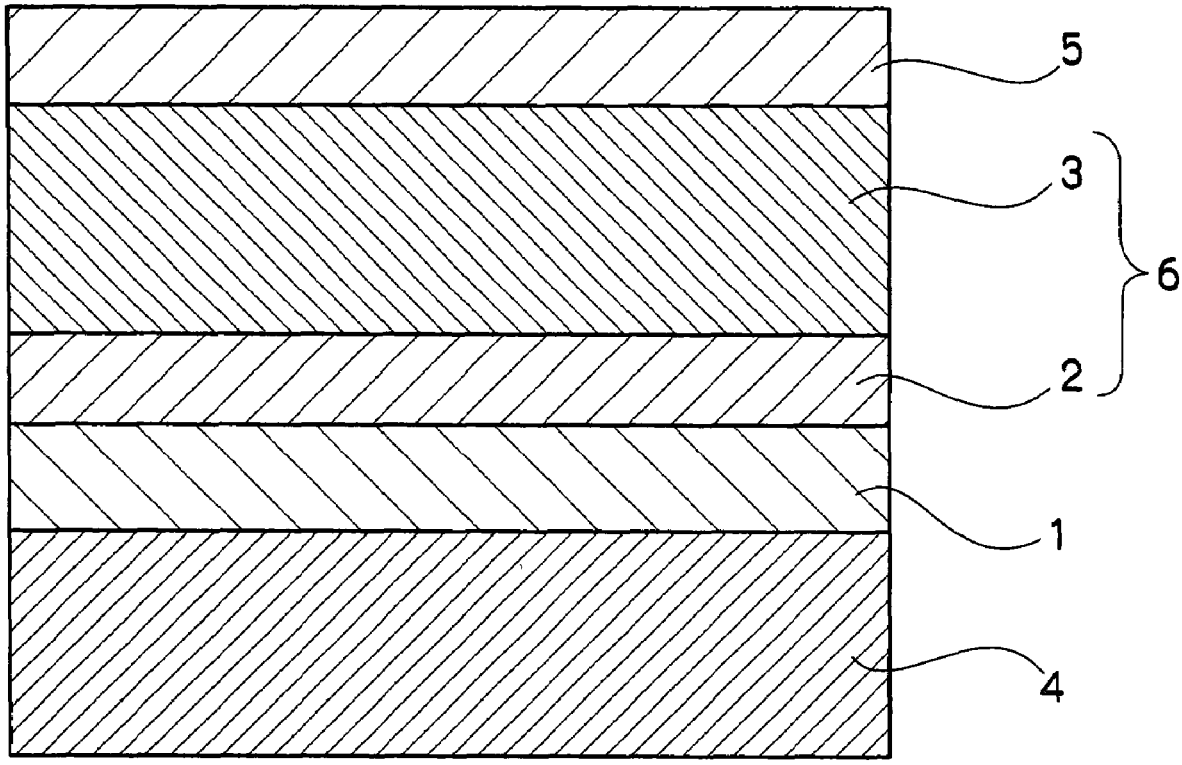
FIG. 14 is a cross sectional view of the electrophotographic photoreceptor in accordance with an exemplary embodiment.

FIG. 14 is an illustration showing a section of the electrophotographic photoreceptor in this exemplary embodiment.

In FIG. 14, an undercoat layer 1 is arranged on a cylindrical support 4, and on or above the undercoat layer, a charge-generating layer 2 and a charge-transporting layer 3 are arranged, and a protective layer 5 is formed on the top. In this exemplary embodiment, the undercoat layer 1 and the protective layer 5 may or may not be arranged. In this exemplary embodiment, a photosensitive layer 6 is constituted to separate its function into the charge-generating layer 2 and the charge-transporting layer 3. The charge-generating layer 2 means the above-described charge-generating layer.

Next, layers other than the charge-generating layer constituting the electrophotographic photoreceptor are described.

(Cylindrical Support 4)

In this exemplary embodiment, a cylindrical support 4 is used as base material.

The cylindrical support 4 may be, for example, a metal plate, a metal drum or a metal belt formed of a metal such as aluminum, copper, zinc, stainless steel, chromium, nickel, molybdenum, vanadium, indium, gold or platinum, or their alloy, as well as paper, plastic films or belts coated, deposited or laminated with a polymer with a volume resistivity of $10^{-5}$ Ω·cm or less or indium oxide or with a metal such as aluminum, palladium or gold or their alloy.

The volume resistivity of the cylindrical support is preferably $10^{-5}$ Ω·cm or less.

The surface of the cylindrical support 4 may be roughened so that the central line average surface roughness Ra of the support is preferably from 0.04 μm to 0.5 μm.

For roughening the surface of the support, for example, employable is a wet-honing method of jetting an abrasive suspension in water to a support; a centerless grinding method of pressing a support against a rotating grindstone for continuously grinding it; or a method of anodic oxidation, and it is also preferable to use a method wherein a layer in which a powder having a volume resistivity of $10^{-5}$ Ω·cm or less is dispersed in a resin layer is formed on the surface of the support without roughened, and the surface is roughed by the particles dispersed in the layer.

When non-interference light is used as a light source, roughening for prevention of interference pattern is not particularly necessary.

As one method of roughening the surface of the support, the anodic oxidation comprises processing the aluminum surface of a support in an electrolytic solution in which the aluminum acts as an anode for anodic oxidation to form an oxide film on the aluminum surface. The electrolytic solution includes sulfuric acid solution and oxalic acid solution. Preferably, the thickness of the oxide film by anodic oxidation is preferably from 0.3 μm to 15 μm for sealing the fine pores thereof.

The treatment with an acid solution, such as phosphoric acid, chromic acid and hydrofluoric acid, may be effected as follows. The blend ratio of phosphoric acid, chromic acid and hydrofluoric acid to form an acid solution is preferably as follows: Phosphoric acid is from 10 wt % to 11 wt %, chromic acid is from 3 wt % to 5 wt %, and hydrofluoric acid is from 0.5 wt % to 2 wt %. The total acid concentration of these is preferably from 13.5 wt % to 18 wt %. The processing temperature is preferably from 42° C. to 48° C.

Preferably, the thickness of the film is from 0.3 μm to 15 μm.

The boehmite treatment may be attained by dipping the support in pure water at 90 to 100° C. for 5 to 60 minutes, or by contacting the support with heated steam at 90 to 120° C. for 5 to 60 minutes. Preferably, the thickness of the film is from 0.1 to 5 μm. This may be further processed for anodic oxidation with an electrolytic solution having low film dissolution ability, such as a solution of adipic acid, boric acid, borate, phosphate, phthalate, maleate, benzoate, tartrate or citrate.

(Undercoat Layer 1)

An undercoat layer 1 may also be formed on the cylindrical support, or between the layer formed on the cylindrical support and the photosensitive layer. Particularly, the undercoat layer 1 that is an intermediate layer is preferably formed.

The material used in forming the undercoat layer 1 includes organozirconium compounds such as zirconium chelate compound, zirconium alkoxide compound and zirconium coupling agent; organotitanium compounds such as titanium chelate compound, titanium alkoxide compound and titanate coupling agent; organoaluminum compounds such as aluminum chelate compound and aluminum coupling agent; or organometallic compounds such as antimony alkoxide compound, germanium alkoxide compound, indium alkoxide compound, indium chelate compound, manganese alkoxide compound, manganese chelate compound, tin alkoxide compound, tin chelate compound, aluminum silicon alkoxide compound, aluminum titanium alkoxide compound and aluminum zirconium alkoxide compound, among which the organozirconium compounds, organotitanium compounds or organoaluminum compounds are particularly preferably used.

Further, silane coupling agents such vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane may be used in the undercoat layer.

As another constituent component generally used in the undercoat layer 1, it is also possible to use known binder resins, for example polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid.

The resin may be used alone or in combination of two or more thereof, and the mixing ratio of these materials may be suitably established depending on necessity.

An electron transportable pigment may be mixed or dispersed in the undercoat layer 1. The electron transportable pigment include organic pigments such as perylene pigment described in JP-A No. 47-30330, bisbenzimidazole perylene pigment, polycyclic quinone pigment, indigo pigment and quinacridone pigment; organic pigments such as bisazo pigment and phthalocyanine pigment having an electron attractive substituent group such as a cyano group, a nitro group, a nitroso group and a halogen atom; and inorganic pigments such as zinc oxide and titanium oxide.

Among these pigments, perylene pigment, bisbenzimidazole perylene pigment, polycyclic quinone pigment, zinc oxide and titanium oxide are preferably used.

The surfaces of these pigments may be treated with the above-mentioned coupling agent, binder or the like for the purpose of regulating dispersibility or charge transportability. The electron transportable pigment is used in an amount of 95 wt % or less, and preferably 90 wt % or less.

As the method of mixing/dispersing the constituent component of the undercoat layer 1, a usual method of using a ball mill, a roll mill, a sand mill, an atrighter or supersonic waves is used. Mixing/dispersion is carried out in an organic solvent. The organic solvent may be any organic solvent, as long as the organic solvent dissolves an organic metallic compound and resin and don't cause gelation or aggregation upon mixing/dispersion of the electron transportable pigment.

For example, the organic solvent includes an usual organic solvent such as methanol, ethanol, n-propanol, n-butanol, benzyl alcohol, methyl Cellosolve, ethyl Cellosolve, acetone, methyl ethyl ketone, cyclohexanone, methyl acetate, n-butyl acetate, dioxane, tetrahydrofuran, methylene chloride, chloroform, chlorobenzene and toluene. The organic solvent may be used alone or in combination of two or more thereof.

Various organic compound powder or inorganic compound powder may be added to the undercoat layer 1 for the purpose of improving the electric properties and the light-scatterability of the layer. In particular, white pigments such as titanium oxide, zinc oxide, zinc white, zinc sulfide, lead white or lithopone; inorganic pigments as body pigments such as alumina, calcium carbonate or barium sulfate; Teflon (trade name) resin particles, benzoguanamine resin particles or styrene particles are effective.

Preferably, the particle size of the additive powder is preferably from 0.01 to 2 μm in terms of volume-average particle diameter. The additive powder is optionally added to the layer. When the additive powder is added, its amount is preferably from 10 to 90 wt %, and more preferably from 30 to 80 wt %, with regard to the total solid content of the undercoat layer 1.

Incorporation of an electron-transporting substance, an electron-transporting pigment etc. into the undercoat layer 1 is also effective.

The thickness of the undercoat layer 1 is preferably from 0.01 μm to 30 μm, and more preferably from 0.05 μm to 25 μm. A powdery substance, when added in preparing a coating solution for forming the undercoat layer 1, is added to and dispersed in a solution of the resin component.

As a dispersing method, any ordinary method may be employed by using, for example, a roll mill, a ball mill, a vibrating ball mill, an attritor, a sand mill, a colloid mill, or a paint shaker. The undercoat layer 1 may be formed by applying a coating solution for forming the undercoat layer 1 on or above the cylindrical support 4 and drying it.

The coating method may be any ordinary one, including, for example, a blade coating method, a wire bar coating method, a spraying method, a dipping method, a bead coating method, an air knife coating method and a curtain coating method.

(Charge-transporting Layer 3)

The charge-transporting layer 3 will be described in detail.

As the charge-transporting layer 3, a layer formed by known techniques may be used. The charge-transporting layer 3 may be formed by using a charge transport material and resin or by using a polymer charge transport material.

The charge transport material includes electron transport compounds, for example quinone compounds such as p-benzoquinone, chloranil, bromanil or anthraquinone; tetracyanoquinodimethane compound; fluorenone compound such as 2,4,7-trinitrofluorenone; xanthone compound; benzophenone compound; cyanovinyl compound and ethylene compound. The charge transport material includes hole transport compounds such as triaryl amine compound, benzidine compound, aryl alkane compound, aryl-substituted ethylene compound, stilbene compound, anthracene compound and hydrazone compound.

These charge transport materials may be used alone or in combination of two or more thereof, and the charge transport material is not limited thereto. These charge transport materials are preferably those having structures represented by the following formulae:

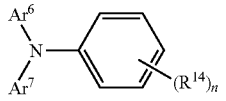

wherein $R^{14}$ represents a hydrogen atom or a methyl group; n indicates 1 or 2; $Ar^6$ and $Ar^7$ each independently represent a substituted or unsubstituted aryl group, $—C_6H_4—C(R^{18})=C(R^{19})(R^{20})$ or $—C_6H_4—CH=CH—CH=C(Ar)_2$, and the substituent for these is a halogen atom, an alkyl group having from 1 to 5 carbon atoms, an alkoxy group having from 1 to 5 carbon atoms, or a substituted amino group substituted with an alkyl group having from 1 to 3 carbon atoms; Ar represents a substituted or unsubstituted aryl group; and $R^{18}$, $R^{19}$ and $R^{20}$ each independently represent a hydrogen atom, a substituted or unsubstituted alkyl group, or a substituted or unsubstituted aryl group.

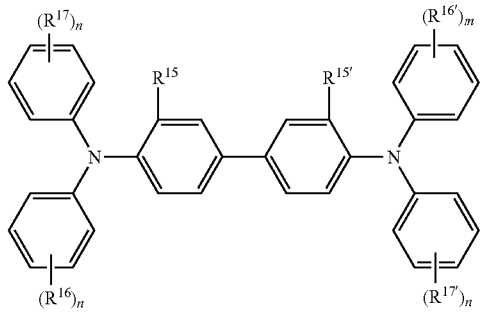

In the above formula, $R^{15}$ and $R^{15}$, may be the same or different, and each independently represent a hydrogen atom, a halogen atom, an alkyl group having from 1 to 5 carbon atoms, or an alkoxy group having from 1 to 5 carbon atoms; $R^{16}$, $R^{16}$, $R^{17}$ and $R^{17}$, may be the same or different, and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C(R^{18})=C(R^{19})(R^{20})$, or $—CH=CH—CH=C(Ar)_2$; $R^{18}$, $R^{19}$ and $R^{20}$ each independently represent a hydrogen atom, a substituted or unsubstituted alkyl group, a substituted or unsubstituted aryl group; Ar represents a substituted or unsubstituted aryl group; and each of m and n each independently represent an integer of from 0 to 2.

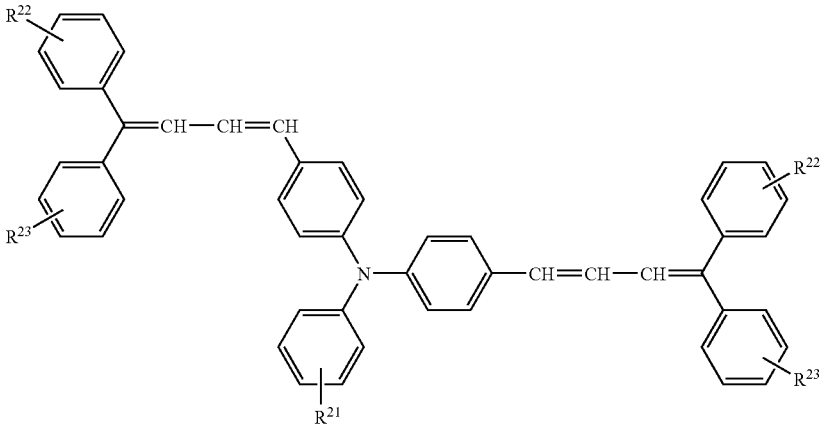

In the formula, $R^{21}$ represents a hydrogen atom, an alkyl group having from 1 to 5 carbon atoms, an alkoxy group having from 1 to 5 carbon atoms, a substituted or unsubstituted aryl group, or $—CH=CH—CH=C(Ar)_2$; Ar represents a substituted or unsubstituted aryl group; $R^{22}$ and $R^{23}$ may be the same or different and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, or a substituted or unsubstituted aryl group.

The binder resin used in the charge-transporting layer 3 includes polycarbonate resin, polyester resin, methacryl resin, acryl resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicon resin, silicon-alkyd resin, phenol-formaldehyde resin, styrene-alkyd resin, polymer charge transport materials such as poly-N-vinyl carbazole, polysilane, polyesteric polymer charge transport materials described in JP-A No. 8-176293 and JP-A No. 8-208820. These binder resins may be used alone or in combination of two or more thereof.

The compounding ratio (weight ratio) of the charge transport material to the resin is preferably from 10:1 to 1:5.

The polymer charge transport materials may be used alone.

As the polymer charge transport materials, known materials having charge transportability, such as poly-N-vinyl carbazole and polysilane, may be used. Particularly polyesteric polymer charge transport materials described in JP-A No. 8-176293 and JP-A No. 8-208820 are particularly preferable. The polymer charge transport material only may be used as the charge-transporting layer 3, or in combination with the resin to form a coating.

The thickness of the charge-transporting layer 3 is generally from 5 μm to 50 μm, and preferably from 10 μm to 30 μm.

The coating method includes a usual method such as blade coating, Meyer bar coating, spray coating, dip coating, bead coating, air knife coating and curtain coating.

The solvent used in arranging the charge-transporting layer 3 includes usual organic solvents such as aromatic hydrocarbons such as benzene, toluene, xylene or chlorobenzene; ketones such as acetone or 2-butanone; halogenated aliphatic hydrocarbons such as methylene chloride, chloroform or ethylene chloride; or cyclic or linear ethers such as tetrahydrofuran or ethyl ether. These solvent may be used alone or in combination of two or more thereof.

For the purpose of preventing the deterioration of the photoreceptor by ozone and an oxidizing gas generated in a copier or by light or heat, additives such as an antioxidant, a light stabilizer and a heat stabilizer may be added to the photosensitive layer.

For example, the antioxidant includes hindered phenol, hindered amine, paraphenylene diamine, aryl alkane, hydroquinone, spirochroman, spiroindanone and derivatives thereof, organic sulfur compounds, organic phosphorous compounds or the like. Examples of the light stabilizer include derivatives such as benzophenone, benzotriazole, dithiocarbamate or tetramethyl piperidine.

For the purpose of improvement in sensitivity, reduction in residual potential, reduction in fatigue upon repeated use, etc., at least one kind of electron receptor may be contained. The electron receptor usable in the photoreceptor includes, for example, succinicanhydride, maleicanhydride, dibromomaleicanhydride, phthalicanhydride, tetrabromophthalicanhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic. Among these compounds, benzene derivatives having electron attractive substituent groups such as a fluorenonic group, a quinonic group, Cl, CN or $NO_2$ are particularly preferable.

(Protective Layer 5)

The protective layer (layer constituting the outermost layer) 5 will be described in detail.

To confer resistance with respect to abrasion, scratch or the like on the surface of the protective layer, a high-strength protective layer may also be arranged. This high-strength protective layer is preferably a layer wherein particles with volume resistivity of $10^7$ Ω·cm or less are dispersed in a resin, or lubricating particles such as a fluorine resin, an acryl resin or the like are dispersed in a usual charge-transporting layer material, or a hard coating such as silicon and acryl is used, and the protective layer preferably has a crosslinked structure, and more preferably a charge transport material.

The resin may be either thermosetting or photosetting (including UV-setting).

Specific examples of the resin include phenol resin, epoxy resin, urethane resin, urea resin, siloxane resin or the like, among which a resin having a phenol structure having a charge transportability, such as novolak-based phenol resin, resol-based phenol resin, or epoxy resin having a phenol structure is preferable, and a phenol derivative having at least a methylol group, such as resol-based phenol resin, is more preferable.

The phenol derivatives having a methylol group include monomers of monomethylolphenols, dimethylolphenols or trimethylolphenols, mixtures thereof, oligomers thereof, or mixtures of such monomers and oligomers, which are produced through reaction of phenol structure-containing compounds such as resorcinols or bisphenols with formaldehyde or paraformaldehyde, in the presence of an acid catalyst or an alkali catalyst. The phenol structure-containing compounds include substituted phenols having one hydroxyl group such as phenol, cresol, xylenol, paraalphenol or paraphenryphenol; substituted phenols having two hydroxyl groups such as catechol, resorcinol or hydroquinone; bisphenols or biphenols such as bisphenol A or bisphenol Z. Of the compounds, moleculars having from about 2 to 20 repeating units are referred to as oligomers, and those smaller than such oligomers are referred to as monomers.

The acid catalyst includes, for example, sulfuric acid, paratoluenesulfonic acid or phosphoric acid. The alkali catalyst includes, for example, alkali metal or alkaline earth metal hydroxides such as NaOH, KOH ord $Ca(OH)_2$; or amine catalysts. The amine catalysts include, but are not limited to, ammonia, hexamethylenetetramine, triethylamine, triethylamine, and triethanolamine. When a basic catalyst is used, it is neutralized with an acid, or it is inactivated through contact with an adsorbent such as silica gel or with ion-exchange resin. A catalyst for promoting the curing may be used when a coating solution is prepared. At the time of curing, the catalyst may also be used, and the amount of the catalyst added is preferably 5 wt % or less.

As materials forming a crosslinked structure, various compounds may be used, and from the viewpoint of characteristics, phenol resin, urethane resin and siloxane resin are preferable, and particularly siloxane resin and phenol resin are preferable.

The charge-transporting material may be any may be any charge-transporting material as long as a substance has a charge transporting ability, and may be low-molecular compounds excellent in a charge transporting ability such as hydrazone-based compounds, benzidine-based compounds, amine-based compounds or stilbene-based compounds, and preferably those having a structure capable of crosslinking reaction.

The charge transporting materials capable of crosslinking reaction includes those represented by the following Formulae (I) to (V), and for example, specific structures shown below may be used.

$$F-((X^1)_n-R^1-A)_m \quad \text{Formula (I)}$$

In the formula (I), F represents an organic group derived from a compound having an ability to transport an electron hole, $R^1$ represents an alkylene group, m represents an integer of from 1 to 4, $X^1$ represents oxygen or sulfur, n represents 0 or 1, and A represents a hydroxyl group, a carboxyl group or a thiol group.

$$F-[(X^2)_{n1}-(R^2)_{n2}-(Z^2)_{n3}-G]_{n4} \quad \text{Formula (II)}$$

In the Formula (II), F represents an organic group derived from a compound having an ability to transport an electron hole, $X^2$ represents an oxygen atom or a sulfur atom, $R^2$ represents an alkylene group, $Z^2$ represents an alkylene group, an oxygen atom, a sulfur atom, NH or COO, G represents an epoxy group, n1, n2 and n3 each independently represent 0 or 1, and n4 represents an integer of 1 to 4.

Formula (III)

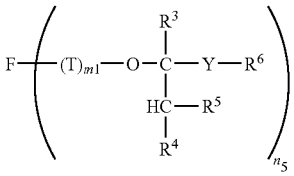

In the Formula (III), F represents an n5-valent organic group having an ability to transport an electron hole, T represents a divalent group, Y represents an oxygen atom or a sulfur atom, $R^3$, $R^4$ and $R^5$ each independently represent a hydrogen atom or a monovalent organic group, $R^6$ represent a monovalent organic group, m1 represents 0 or 1, and n5 represents an integer of 1 to 4, provided that $R^5$ and $R^6$ may be bound to each other to form a heterocyclic ring having Y as heteroatom.

Formula (IV)

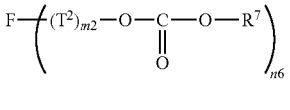

In the Formula (IV), F represents an n6-valent organic group having an ability to transport an electron hole, $T^2$ represents a divalent group, $R^7$ represents a monovalent organic group, m2 represents 0 or 1, and n6 represents an integer of from 1 to 4.

Formula (V)

$$F-(T^3-O-R^0)_{n7}$$

In the Formula (V), F represents an n7-valent organic group having an ability to transport an electron hole, $T^3$ represents a divalent alkylene group, $R^0$ represents a monovalent organic group, and n7 represents an integer of from 1 to 4.

For the purpose of regulating the film formation, flexibility, lubricating properties or adhesion of the protective layer 5, other coupling agents or fluorine compounds may be mixed. As these compounds, various silane coupling agents and commercial silicone-based hard coating agents may be available.

Silane coupling agents include, for example, vinyl trichlorosilane, vinyl trimethoxy silane, vinyl triethoxy silane, γ-glycidoxy propyl methyl diethoxy silane, γ-glycidoxy propyl trimethoxy silane, γ-glycidoxy propyl trimethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, tetramethoxy silane, methyl trimethoxy silane, dimethyl dimethoxy silane, or the like.

The commercial hard coating agents include, for example, KP-85, X-40-9740, X-40-2239 (manufactured by Shin-Etsu Chemical Co., Ltd), AY42-440, AY42-441 or AY49-208 (manufactured by Dow Corning Toray). Fluorine-containing compounds such as (tridecafluoro-1,1,2,2-tetrahydrooctyl) triethoxy silane, (3,3,3-trifluoropropyl)trimethoxy silane, 3-(heptafluoroisopropoxy) propyl triethoxy silane, 1H,1H,2H,2H-perfluoroalkyl triethoxy silane, 1H,1H,2H,2H-perfluorodecyl triethoxy silane and 1H,1H,2H,2H-perfluoroctyl triethoxy silane may be added.

The silane coupling agent may be used in any amount. The amount of the fluorine-containing compound is desirably in an amount of 0.25 part by weight or less with regard to the fluorine-free compound.

A resin soluble in an alcohol may also be added to the protective layer 5.

The alcohol-soluble resin includes, for example, polyvinyl butyral resin, polyvinyl formal resin, polyvinyl acetal resin such as partially acetalated polyvinyl acetal resin having a part of butyral modified with formal, acetoacetal or the like (for example, S-LEC B, K etc. manufactured by Sekisui Chemical Co., Ltd.), polyamide resin, cellulose resin, polyvinyl phenol resin or the like. Particularly, polyvinyl acetal resin or polyvinyl phenol resin are preferable.

The weight-average molecular weight of the resin is preferably from 2,000 to 100,000, and more preferably from 5,000 to 50,000.

The amount of the resin added is preferably from 1 wt % to 20 wt %, more preferably from 1 wt % to 15 wt %, and still more preferably 2 wt % to 10 wt %, with regard to the total solid content of the protective layer 5.

The coating solution for protective layer 5 containing these components may also be produced in the absence of a solvent, but if necessary it is possible to use solvents, for example, alcohols such as methanol, ethanol, propanol or butanol; ketones such as acetone, methyl ethyl ketone or cyclohexanone; ethers such as tetrahydrofuran diethyl ether or dioxane, or the like. These solvents may be use alone or in combination of two or more thereof. Such solvents preferably have a boiling point of 120° C. or less. The amount of the solvent may be regulated.

When the above components are reacted to obtain a coating solution, they may be simply mixed and dissolved, or may be additionally heated at from 20° C. to 100° C., and preferably from 30° C. to 80° C., for 10 minutes to 100 hours, and preferably for 1 hour to 50 hours. Sonication of the mixture is also preferable. By doing so, partial reaction is estimated to proceed to improve coating property.

An antioxidant is preferably added to the protective layer 5.

The antioxidant is preferably a hindered phenol- or hindered amine-based antioxidant, and known antioxidants such as an organic sulfur-based antioxidant, phosphite-based antioxidant, dithiocarbamate-based antioxidant, thiourea-based antioxidant and benzoimidazole-based antioxidant may also be used. The amount of the antioxidant added is preferably 20 wt % or less, and more preferably 10 wt % or less.

The hindered phenolic antioxidants include, for example, 2,6-di-t-butyl-4-methylphenol, 2,5-di-t-butyl hydroquinone, N,N'-hexamethylenebis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethyl phenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate and 4,4'-butylidenebis(3-methyl-6-t-butylphenol).

Various particles may be added to the protective layer 5. By way of example, silicon-containing particles may be mentioned as the particles. The silicon-containing particles are those containing a silicon atom as the constitutive element. Concretely, they include colloidal silica or silicone particles.

Preferably, the colloidal silica as the silicon-containing particles preferably has a mean particle size of from 1 nm to 100 nm, more preferably from 10 nm to 30 nm. It may be an acid or alkaline aqueous dispersion, or a dispersion in an organic solvent such as alcohol, ketone or ester. Ordinary commercial products of such colloidal silica are usable herein.

Though not specifically restricted, the solid content of the colloidal silica in the protective layer 5 is preferably from 0.1 wt % to 50 wt %, and more preferably from 0.1 wt % to 30 wt % with regard to the total solid content of the protective layer 5.

The silicone particles used as the silicon-containing particles are selected from silicone resin particles, silicone rubber particles, and silica particles surface-treated with silicone. Ordinary commercial products of such silicone particles are usable herein. These silicone particles are spherical particles preferably having a mean particle size of from 1 nm to 500 nm, and more preferably from 10 nm to 100 nm.

The content of the silicone particles in the protective layer 5 is preferably from 0.1 wt % to 30 wt %, and more preferably from 0.5 wt % to 10 wt % with regard to the total solid content of the protective layer 5.

Examples of other particles are fluorine-containing particles of ethylene tetrafluoride, ethylene trifluoride, propylene hexafluoride, vinyl fluoride or vinylidene fluoride; resin particles of a copolymer of fluororesin and hydroxyl group-containing monomer described in Preprint for 8th Polymer Material Forum Meeting, p. 89; and metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO.

Oil such as silicone oil may also be added to the layer. The silicone oil includes, for example, silicone oils such as dimethylpolysiloxane, diphenylpolysiloxane or phenylmethylsiloxane; reactive silicone oils such as amino-modified polysiloxanes, epoxy-modified polysiloxanes, carboxyl-modified polysiloxanes, carbinol-modified polysiloxanes, methacryl-modified polysiloxanes, mercapto-modified polysiloxanes and phenol-modified polysiloxanes; dimethyl cyclosiloxane such as hexamethyl cyclotrisiloxane, octamethyl cyclotetrasiloxane, decamethyl cyclopentasiloane and dodecamethyl cyclohexasiloxane, methyl phenyl cyclosiloxanes such as 1,3,5-trimethyl-1,3,5-triphenyl cyclotrisiloxane, 1,3,5,7-tetramethyl-1,3,5,7-tetraphenyl cyclotetrasiloxane, or 1,3,5,7,9-pentamethyl-1,3,5,7,9-pentaphenyl cyclopentasiloxane; phenyl cyclosiloxane such as hexaphenyl cyclotrisiloxane; fluorine-containing cyclosiloxanes such as 3-(3,3,3-trifluoropropyl)methyl cyclotrisiloxane; a methyl hydroxy siloxane mixture, hydrosilyl group-containing cyclosiloxane such as pentamethyl cyclopentasiloxane or phenyl hydrocyclosiloxane; and vinyl group-containing cyclosiloxane such as pentavinyl pentamethyl cyclopentasiloxane. These compounds may be used alone or in combination of two or more thereof. When the compounds are used in combination, they may be simply mixed or may be prepared in the form of a solid solution or in a fused form.

The average particle diameter of the particles is preferably 0.3 μm or less, and more preferably 0.1 μm or less, from the viewpoint of the transparency of the protective layer.

<Image-forming Apparatus>

Figure 15:
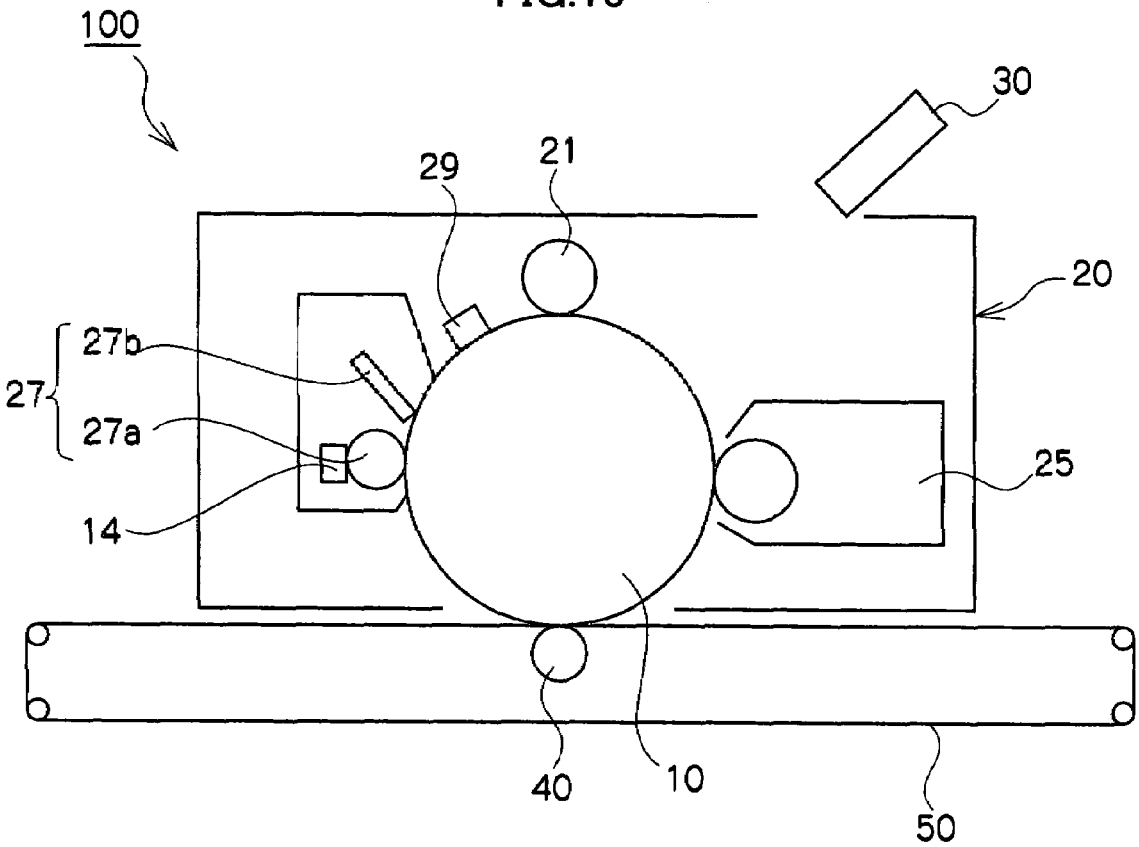
FIG. 15 is a cross sectional view of an image-forming apparatus in accordance with an preferable exemplary embodiment.

FIG. 15 is an illustration showing a preferable embodiment of the image-forming apparatus of the invention. The image-forming apparatus shown in FIG. 15 comprises, in the main body of an image-forming apparatus (not shown), a process cartridge 20 provided with the electrophotographic photoreceptor 10 in this embodiment described above, an irradiating device (latent image-forming apparatus) 30, a transfer device 40, and an intermediate transfer medium 50.

In the image-forming apparatus 100, the irradiating device 30 is arranged in such a position that the electrophotographic photoreceptor 10 can be irradiated with light through an opening of the process cartridge 20, and the transfer device 40 is arranged in a position opposed, via the intermediate transfer medium 50, to the electrophotographic photoreceptor 10, and the intermediate transfer medium 50 is arranged to be butted against, and contacted with, the electrophotographic photoreceptor 10.

The process cartridge 20 comprises, in a casing, the electrophotographic photoreceptor 10 integrated with a charging device 21, a developing device 25, a cleaning device 27 and a fibrous member (flat brush) 29 and fitted via a fitting rail to the main body of the image-forming apparatus. The casing is provided with an opening for light exposure.

The charging device 21 is to charge the electrophotographic photoreceptor 10 by a contact system. The developing device 25 is to form a toner image by developing an electrostatic latent image on the photographic photoreceptor 10.

The cleaner 27 have a fibrous member (roll) 27*a* and a cleaning blade (blade member) 27*b*. In the cleaner 27 shown in FIG. 16, there are both a fibrous member 27*a* and a cleaning blade 27*b*. However, the cleaner may have any one of these. The fibrous member 27*a* may be a roll, a tooth brush-like member or the like. The fibrous member 27*a* may be fixed to the body of the cleaner, or may be rotatably supported by the body, or may be supported by it in such a manner that it may oscillate in the axial direction of the photoreceptor.

The cleaning blade and the cleaning brush of the cleaner 27 remove the adhered substances (e.g., discharged substances) from the surface of the photoreceptor, and it is desirable that a lubricant substance (lubricant component) 14 such as metal soap, higher alcohol, wax or silicone oil is contacted with the fibrous member 27*a*, to supply the lubricant component to the surface of the electrophotographic photoreceptor.

The cleaning blade 27*b* may be an ordinary rubber blade.

The process cartridge 20 described above is detachably fitted to the main body of the image-forming apparatus, and constitutes the image-forming apparatus, together with the main body of the image-forming apparatus.

The exposure unit 30 may be any one capable of exposing the charged electrophotographic photoreceptor 10 so as to form an electrostatic latent image thereon. The light source of the exposure unit 30 is preferably a multi-beam surface-emitting laser.

Figure 16:
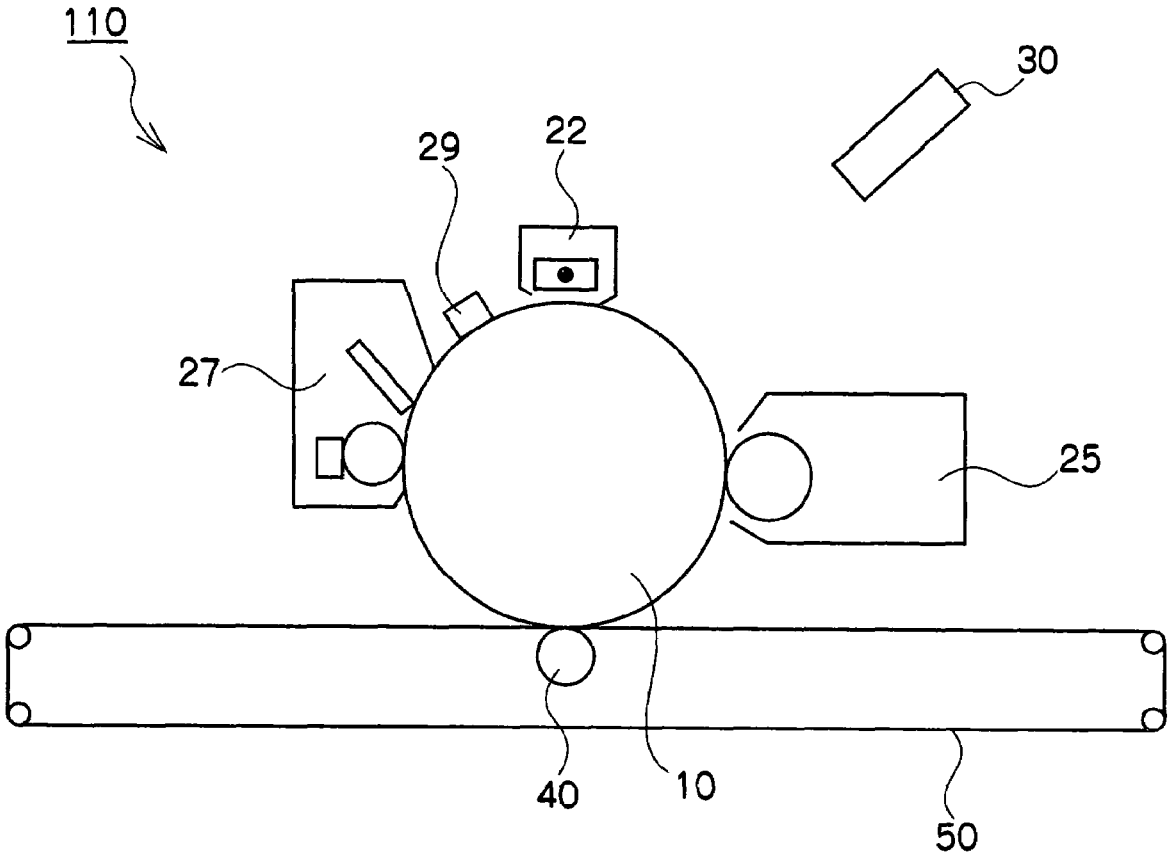
FIG. 16 is a cross sectional view of an image-forming apparatus in accordance with another preferable exemplary embodiment.

The transfer unit 40 is not limited insofar as it may transfer a toner image on the electrophotographic photoreceptor 10 onto a transfer medium (which may be a paper retained on a paper delivery belt (not shown) used in place of the intermediate transfer medium 50 as transfer medium shown in FIG. 16, or a paper for directly transferring an image thereon without using the intermediate transfer medium 50), and for example, a usual roll-shaped transfer material is used.

The intermediate transfer medium 50 has a volume resistivity of $10^2$ Ω·cm to $10^{11}$ Ω·cm, and is a belt-shaped medium (intermediate transfer belt) containing polyimide, polyamidimide, polycarbonate, polyarylate, polyester, rubber or the like as the constituent component. The intermediate transfer medium 50 may be in the form of a drum in addition to the form of a belt.

The transfer medium is not particularly limited insofar as it is a medium capable of transferring a toner image formed on the electrophotographic photoreceptor 10. For example, in the case where the electrophotographic photoreceptor 10 is transferred directly onto a paper, the paper is a transfer medium, and when the intermediate transfer medium 50 is used, the intermediate transfer medium is a transfer medium.

FIG. 16 is a schematic view showing another exemplary embodiment of the image-forming apparatus. In the image-forming apparatus 110 of FIG. 16, the electrophotographic photoreceptor 10 is fixed to the body of the image-forming apparatus, and a charger 22, a developer 25 and a cleaner 27 are fitted thereto independently of each other, to constitute a charging cartridge, a developing cartridge and a cleaning cartridge respectively. The charger 22 is a corona discharging charger in the exemplary embodiment.

In the image-forming apparatus 110, the electrophotographic photoreceptor 10 and the other units are separated from one another, and the charger 22, the developer 25 and the cleaner 27 may be detachably fitted to the body of the image-forming apparatus by leading or extrusion.

In the electrophotographic photoreceptor of this exemplary embodiment, formation of the cartridge is not necessary in some cases. Accordingly, the charger 22, the developer 25 and the cleaner 27 may be detachably fitted to the body of the image-forming apparatus by leading or extrusion, whereby the apparatus cost per one print with it may be reduced. Two or more of these units may be manufactured as one integrated cartridge to detachably fix to the body.

The image-forming apparatus 110 has the same structure as the image-forming apparatus 100 except that the charger 22, the developer 25 and the cleaner 27 are formed as cartridges respectively.

Figure 17:
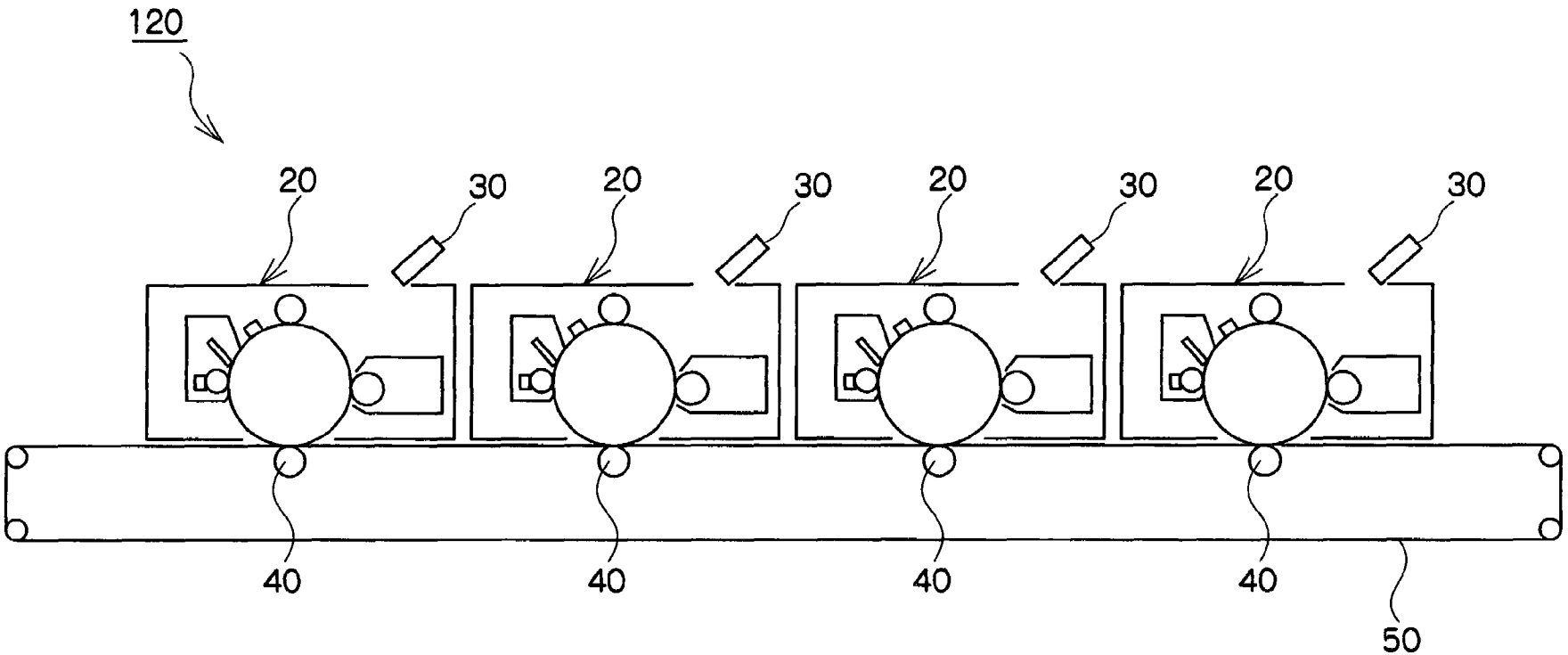
FIG. 17 is a cross sectional view of the image-forming apparatus in accordance with still another preferable exemplary embodiment.

FIG. 17 is a schematic view showing still another exemplary embodiment of the image-forming apparatus. The image-forming apparatus 120 is a tandem-type full-color image-forming apparatus equipped with four process cartridges 20. The image-forming apparatus 120 is so designed that four process cartridges 20 are disposed in parallel to each other on an intermediate transfer medium 50 and one electrophotographic photoreceptor is used for one color. Except that it is a tandem-system apparatus, the image-forming apparatus 120 has the same constitution as that of the image-forming apparatus 100.

EXAMPLES

Hereinafter, the exemplary embodiment of the present invention is described in more detail with reference to the Examples, to which, however, the present invention is not limited.

Example 1

<Preparation of Photoreceptor>

A cylindrical aluminum support has outer diameter of 30 mm and length of 253 mm. The outer periphery of the cylindrical aluminum support is polished with a centerless polishing apparatus to give a cylinder having a surface roughness (ten-point average roughness) Rz of 0.6 μm. This cylinder is degreased, and then etched with an aqueous 2 wt % sodium hydroxide solution for 1 minute, successively neutralized and washed with pure water.

Next, this aluminum support is subjected to anodic oxidation with a 10 wt % sulfuric acid solution (current density, 1.0 A/dm$^2$) to thereby form an oxide film on its surface. After washed with water, the support is dipped in a 1 wt % nickel acetate solution at 80° C. for 20 minutes for sealing the anodic oxide film. Further, the support is washed with pure water and dried. In this manner, a cylindrical support having a 7-μm anoxic oxide film formed on the outer periphery thereof is obtained.

In the next place, with a weight ratio of chlorogallium phthalocyanine where a Bragg angle (2θ±0.2°) of an X-ray diffraction spectrum has strong diffraction peaks at 7.4°, 16.6°, 25.5° and 28.3° to polyvinyl butyral (trade name: S-LEC BM-S, produced by Sekisui Chemical Co., Ltd.) (P/B ratio=weight of charge-generating material/weight of resin) set to 2, n-butyl acetate is added thereto so that a solid concentration is 7.5 wt %, followed by dispersing for 1 hr together with glass beads by use of a paint shaker, further followed by filtering to remove glass beads, and thereby a coating solution 1-1 having the viscosity of 6.2 mPa·s is obtained.

Furthermore, a coating solution 1-2 of which viscosity is 5.0 mPa·s is obtained in a similar manner as the preparation of the coating solution 1-1 except that the P/B ratio is set to 1 and the solid concentration is set at 5 wt %.

Figure 18:
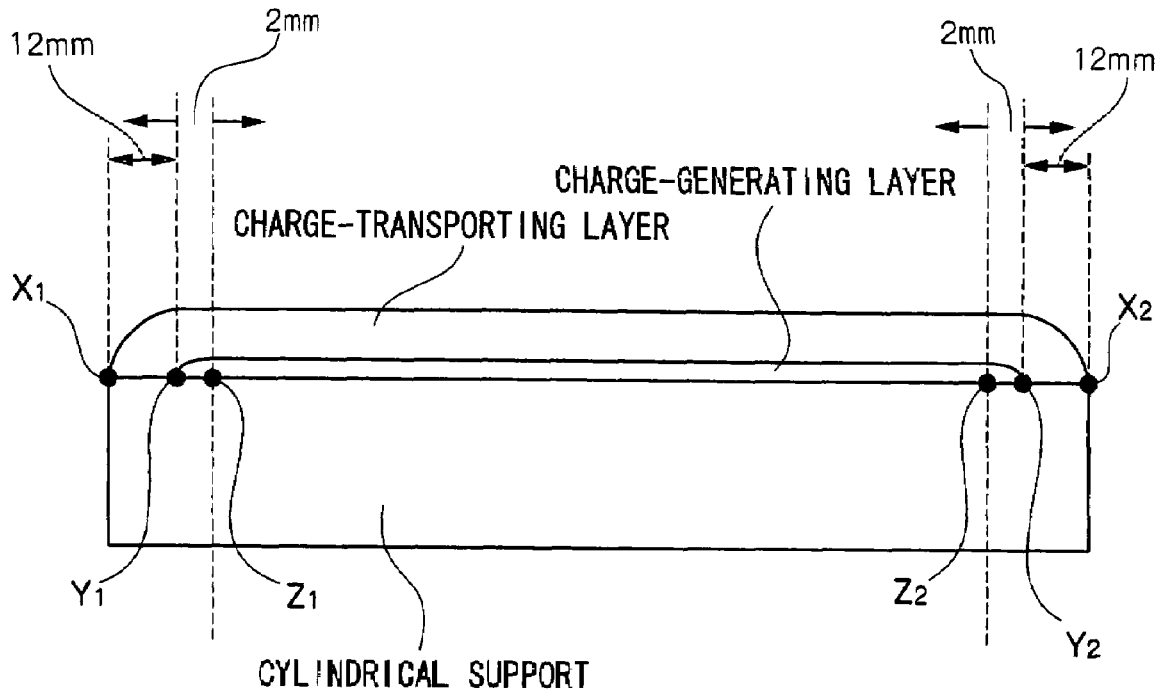
FIG. 18 is an illustration showing the shape of a charge-generating layer prepared in the Examples.

As shown in FIG. 18, as a test sample, the charge-generating layer-forming coating solution is applied by the ink jet method onto the outer peripheral surface of the above cylindrical support with a region from the position $Y_1$ to the position $Y_2$. The position $Y_1$ is located 12 mm toward the central portion from one end $X_1$ of the cylindrical support. The position $Y_2$ is located 12 mm toward the central portion from one end $X_2$ of the cylindrical support.

The reason why the position 12 mm from the end $X_1$ is set as the position $Y_1$ for initiation of coating is because the sensitivity of the photoreceptor is measured under conditions where the thickness of the charge-transporting layer is not varied in the axial direction. When the charge-transporting layer is formed on the charge-generating layer, the charge-transporting layer is thicker than the charge-generating layer, whereby the coating film easily drips, and the ends in the axial direction tend to be different in layer thickness. That is, a broad region not coated with the charge-generating layer is provided from $X_1$ to $Y_1$ and from $X_2$ to $Y_2$ so that the thickness of the charge-transporting layer becomes constant in the coating region from $Y_1$ to $Y_2$ of the charge-generating layer.

In this example, because of coating starts at $Y_1$, the position located 2 mm toward the central portion from $Y_1$ is the end portion $Z_1$. However, application of the coating solution for charge-generating layer may start at $X_1$, and in this case, the position located 2 mm toward the central portion from $X_1$ is the end portion.

As a droplet discharge head for discharging a coating solution 1-1, a piezoelectric intermittent Pixel Jet 64 having 32 nozzles×2 arrays manufactured by Trident is used, and out of 64 nozzles in the droplet discharge head, 20 nozzles in one array are used.

As a droplet discharge head that discharges a coating solution 1-2, a piezo intermittent MJ510C having 64 nozzles×1 arrays manufactured by Epson Co., Ltd. is used and all 64 nozzles of the droplet discharge head are used.

The droplet discharge head that discharges the coating solution 1-1 is arranged at an inclined angle of 78° to the axis of the cylindrical support, while the droplet discharge head that discharges the coating solution 1-2 is arranged at an inclined angle of 81° to the axis of the cylindrical support, where the distance between the droplet discharge head and the cylindrical support is 1 mm.

With an axis of a cylindrical support held so as to be level, with the cylindrical support rotating at 200 rpm, and with scanning speeds of all of the droplet discharge heads toward an axial direction set to 540 mm/min, a coating operation is applied with the droplet discharge heads aligned.

Figure 19A:
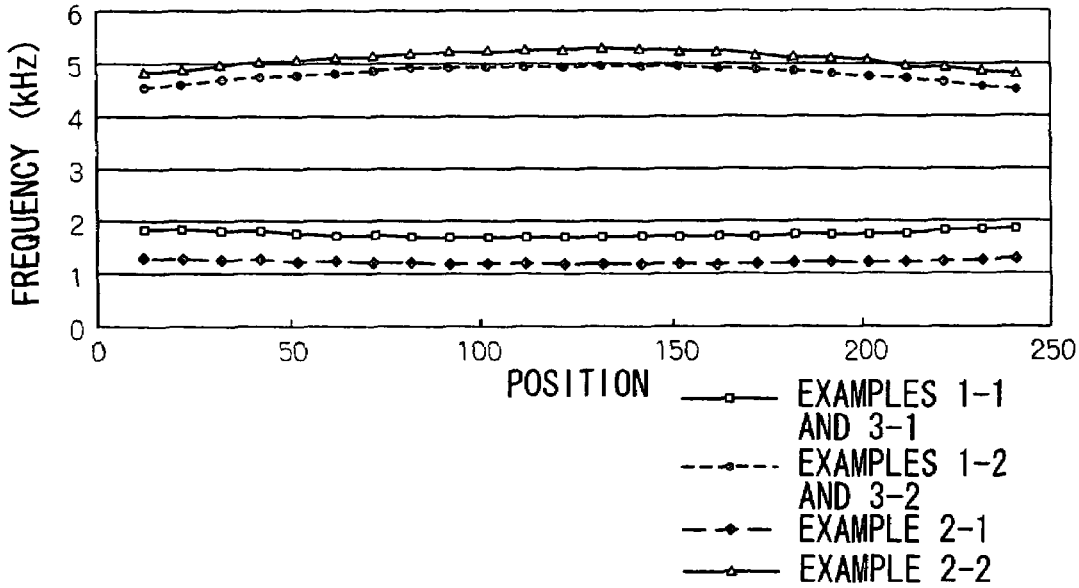
FIG. 19A is a graph showing a state of controlling discharge frequencies of two pairs of discharge heads during scanning them at uniform speeds in the axial direction of a cylinder in the Examples.

As shown in FIG. 19A, in the droplet discharge heads that discharge a coating solution 1-1, a frequency is controlled so as to be high at end portion sides of the cylindrical support and to be low at a center portion thereof to vary a liquid droplet volume from a nozzle. An average liquid droplet volume from the droplet discharge head that discharges the coating solution 1-1 is set at 50 pl. A diameter of a liquid droplet is measured by off-line visualization and evaluated. In synchronization with a discharge timing, an LED is turned on toward a liquid droplet and an image is observed with a CCD camera.

On the other hand, as shown in FIG. 19A, in droplet discharge heads that discharge a coating solution 1-2, a frequency is controlled so as to be low at end portion sides of the cylindrical support and to be high at a center portion thereof to vary a liquid droplet volume from a nozzle. An average liquid droplet volume from the droplet discharge head that discharges the coating solution 1-2 is set at 8 pl.

After the above operations, heating and drying are applied at 100° C. for 10 min and thereby a charge-generating layer is obtained.

Next, 2.5 parts by weight of a benzidine compound of the following formula (A-1), and 3 parts by weight of a polymer compound having structural units of the following formula (B-1) (having a viscosity-average molecular weight of 39,000) are dissolved in a mixed solvent of 5 parts by weight of chlorobenzene and 15 parts by weight of tetrahydrofuran to prepare a coating solution for forming a charge-transporting layer.

The cylindrical support 1 having the charge-generating layer formed thereon is coated by dipping with the coating solution for forming the charge-transporting layer. In this dip coating, the cylindrical support is dipped, to a position located 2 mm from the end $X_1$ of the cylindrical support, in the coating solution for forming the charge-transporting layer. And then, the coating of charge-transporting layer starts by raising the cylindrical support, and finishes by completely raising the cylindrical support from the coating solution, whereby the coating solution is applied until the other end $X_2$. Thereafter, the terminal region of 2 mm in width from the other end $X_2$ is wiped out, and the support is heated at 120° C. for 40 minutes to form a charge-transporting layer of 20 μm in thickness to prepare photoreceptor-1.

(A-1)

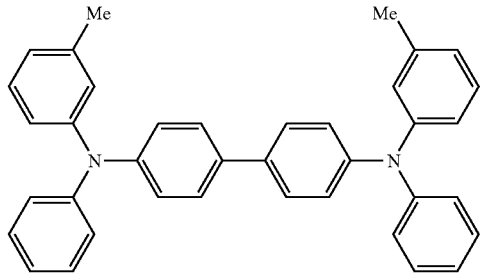

(B-1)

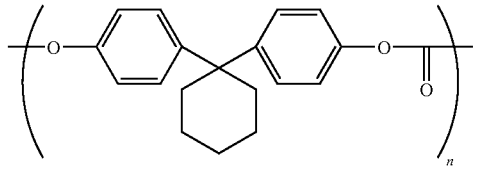

Example 2

A photoreceptor-2 is prepared in a similar manner as the preparation of a charge-generating layer of example 1, except that the solid contents, viscosities of the coating solutions, setting conditions and coating conditions of the droplet discharge heads are changed as shown in Table 2.

A situation of controlling a frequency of droplet discharge heads in example 2 is shown in FIG. 19A.

Example 3

A photoreceptor-3 is prepared similarly to the preparation of a charge-generating layer of example 1, except that the solid contents, viscosities of the coating solutions, setting conditions and coating conditions of the droplet discharge heads are changed as shown in Table 2.

A frequency of droplet discharge heads of a coating solution 3-1 in example 3 is controlled in a similar manner as that of the coating solution 1-1 in example 1 and a frequency of droplet discharge heads of a coating solution 3-2 is controlled same as that of the coating solution 1-2 in example 1. A situation thereof is shown in FIG. 19A.

Comparative Example 1

In example 1, a charge-generating layer is prepared by use of an inkjet method. In comparative example 1, a photoreceptor-4 is prepared in a similar manner as in example 1 except that a charge-generating layer is prepared by use of a dip coating method described below.

Figure 20A:
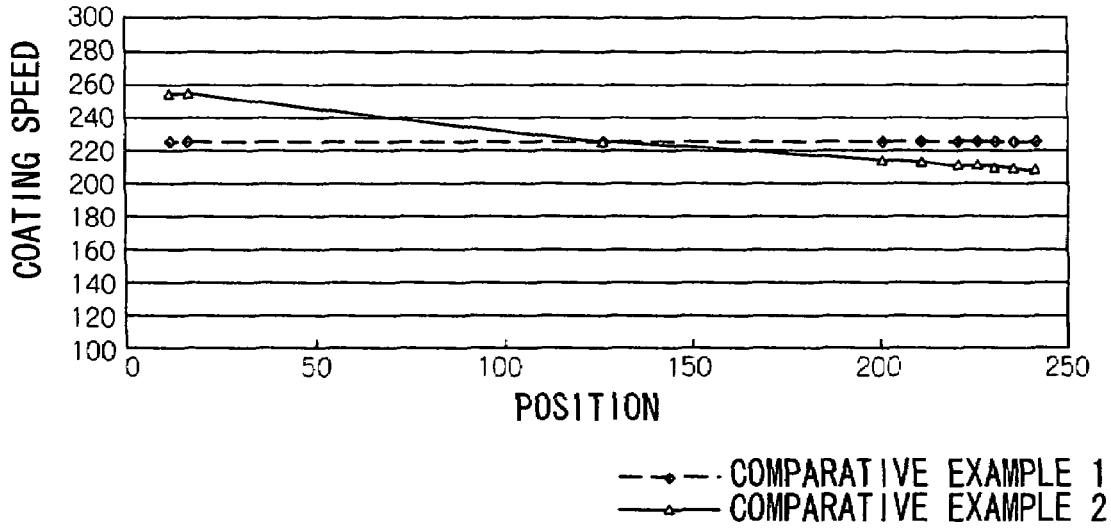
FIG. 20A is a graph showing a state of controlling coating speed in the Comparative Examples.
Figure 21:
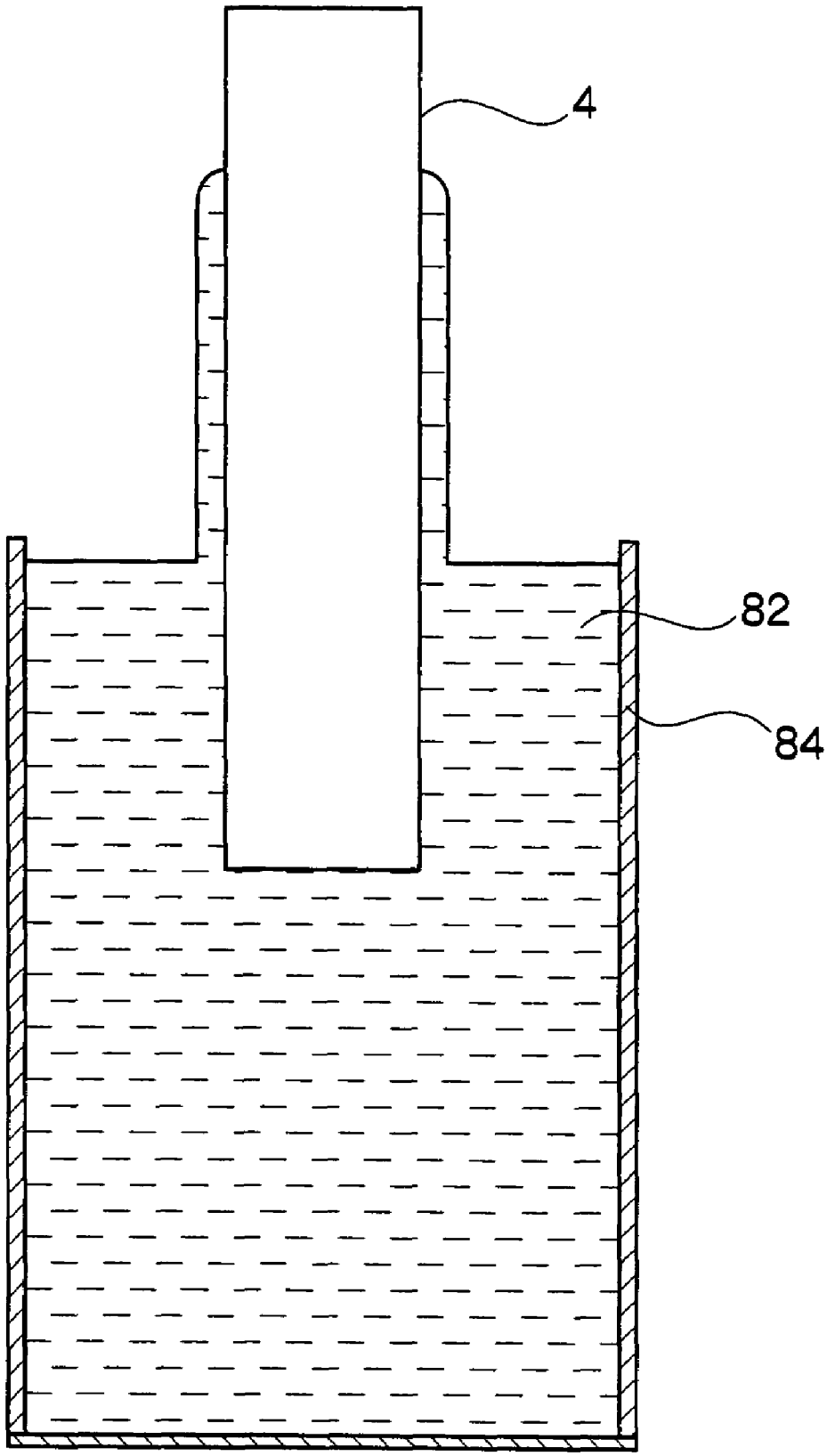
FIG. 21 is a diagram for describing a configuration of a dip coating unit used to form a charge-generating layer in a comparative example.

A dip coating apparatus used in comparative example 1 has a configuration shown in FIG. 21. A coating solution 82 (coating solution 1-2 in comparative example 1) is charged in a coating bath 84 and a cylindrical support 4 is dipped in and pulled up to perform coating. A charge-generating layer of comparative example 1 is prepared in such a manner that a cylindrical support obtained similarly to example 1 is disposed in a vertical direction as shown in FIG. 21, the cylindrical support 4 is dipped in a charge-generating layer coating solution of example 1 up to a position located 12 mm from a top end thereof, followed by pulling up while maintaining a speed of 225 mm/min. The coating speed is shown in FIG. 20A. Thereafter, a coated film in a region up to a position located 12 mm from a bottom end side in the coating of the cylindrical support is wiped off to form a charge-generating layer.

Comparative Example 2

In comparative example 1, the cylindrical support is pulled up with a speed maintained. In comparative example 2, a photoreceptor-5 is prepared in a similar manner as in comparative example 1 except that the cylindrical support is pulled up at a coating speed shown in FIG. 20A.

<Evaluation>

(Thickness)

A thickness of a charge-generating layer of an obtained photoreceptor is obtained by observing with a SEM after cutting a section thereof.

As measurement points, in each 3 point of positions $Z_1$ and $Z_2$ at an equidistance in a peripheral direction of a photoreceptor (6 points in total) and 3 points at an equidistance in a peripheral direction of a photoreceptor at a center portion in an axial direction of a photoreceptor of a charge-generating layer, that is, 9 points are taken in total.

An average value of the foregoing 9 points, and ratios (%) of the maximum value and minimum value to the average value are measured. Results are shown in Tables 3 and 4.

(Spectral Absorption Ratio)

A spectral absorption ratio of a charge-generating layer of an obtained photoreceptor is measured between the positions $Y_1$ and $Y_2$ at 5-mm intervals in the axial direction at intervals of every 15° in the circumferential direction (that is, 24 points), followed by averaging obtained values, and thereby a spectral absorption ratio in an axial direction is obtained. Results are shown in FIGS. 19B and 20B.

Figure 19B:
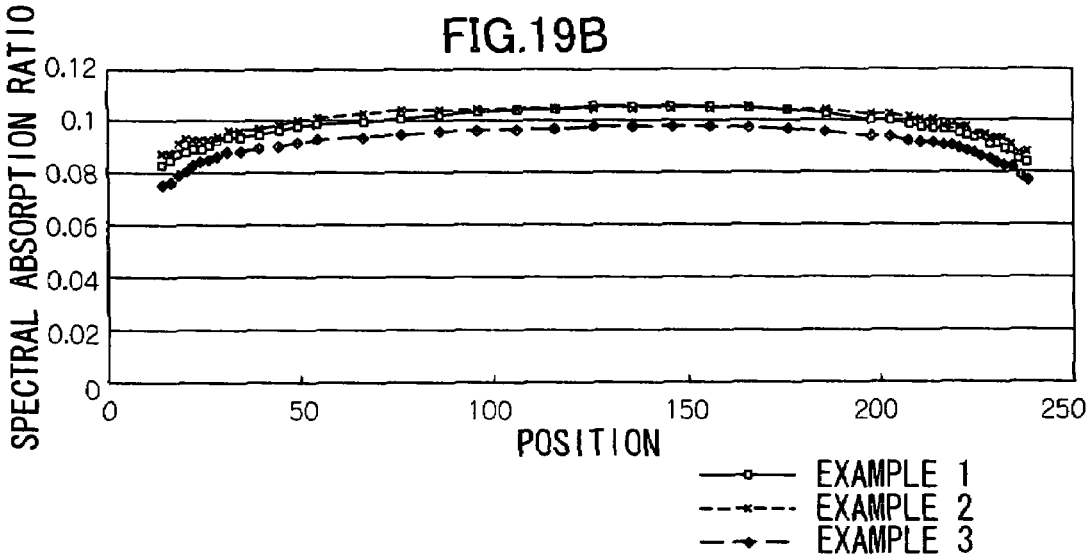
FIG. 19B is a graph showing the spectral absorption ratio distribution of a charge-generating layer obtained in the Examples.
Figure 20B:
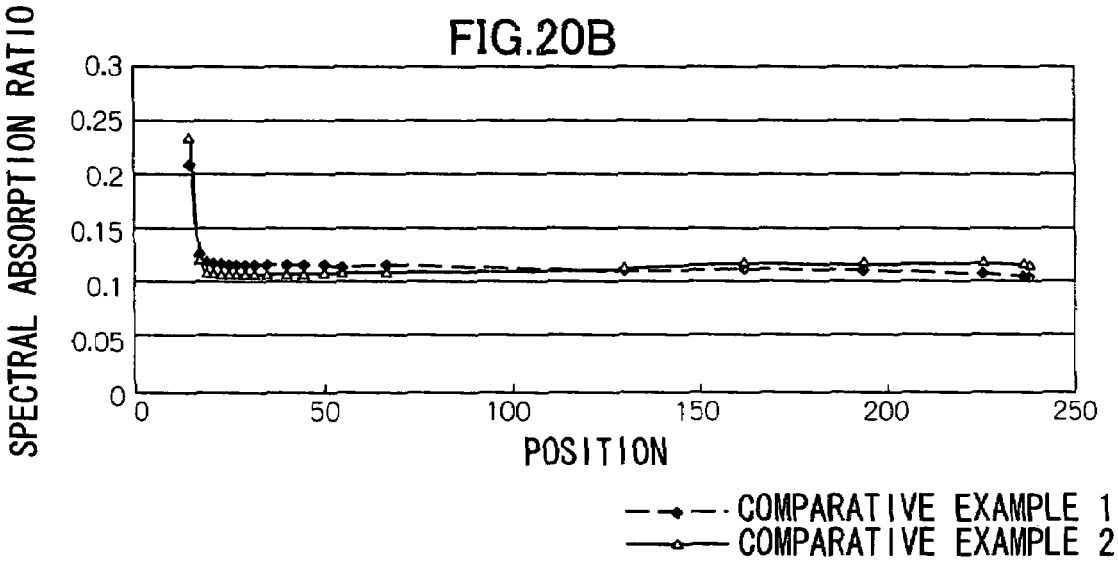
FIG. 20B is a graph showing the spectral absorption ratio distribution of a charge-generating layer obtained in the Comparative Examples.

In FIGS. 19B and 20B, the spectral absorption ratios from the end portion $Z_1$ to and the end portion $Z_2$ are plotted.

The results of the spectral absorption ratio indicate that in Examples 1 and 3, the maximum value position, i.e. the position where the spectral absorption ratio is the maximum, is a position located 2 mm toward the central portion from the position $Y_1$ where coating is initiated. On the other hand, in comparative example 1, the spectral absorption ratio is gradually increased in the direction toward the lower side of the photoreceptor arranged in the vertical direction upon dip coating, and in Comparative Example 2, the maximum value position is a position located 8 mm from $Y_1$.

(Sensitivity)

As sensitivity, VL of a region from the end position $Z_1$ to the end position $Z_2$ is measured.

Figure 20C:
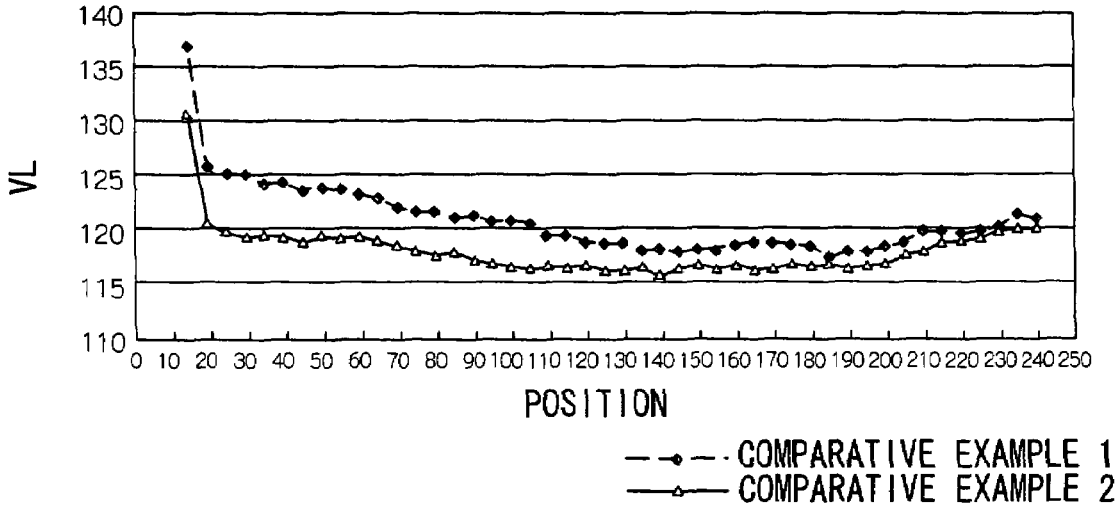
FIG. 20C is a graph showing the sensitivity distribution of a photoreceptor obtained in the Comparative Examples.

When the entire area of this region is charged at −700V and irradiated with 3.7 mJ/m$^2$, the average potential(VL) in the circumferential direction at intervals of every 90° is measured at measurement points at 5-mm intervals in the axial direction. The result of sensitivity distribution in the axial direction is shown in FIG. 20C and FIG. 21C.

$\Delta VL_1$ between the end positions $Z_1$ and $Z_2$ (difference in sensitivity between both end portions) is measured. The results are shown in Tables 3 and 4.

(Image Density Unevenness)

Figure 22:
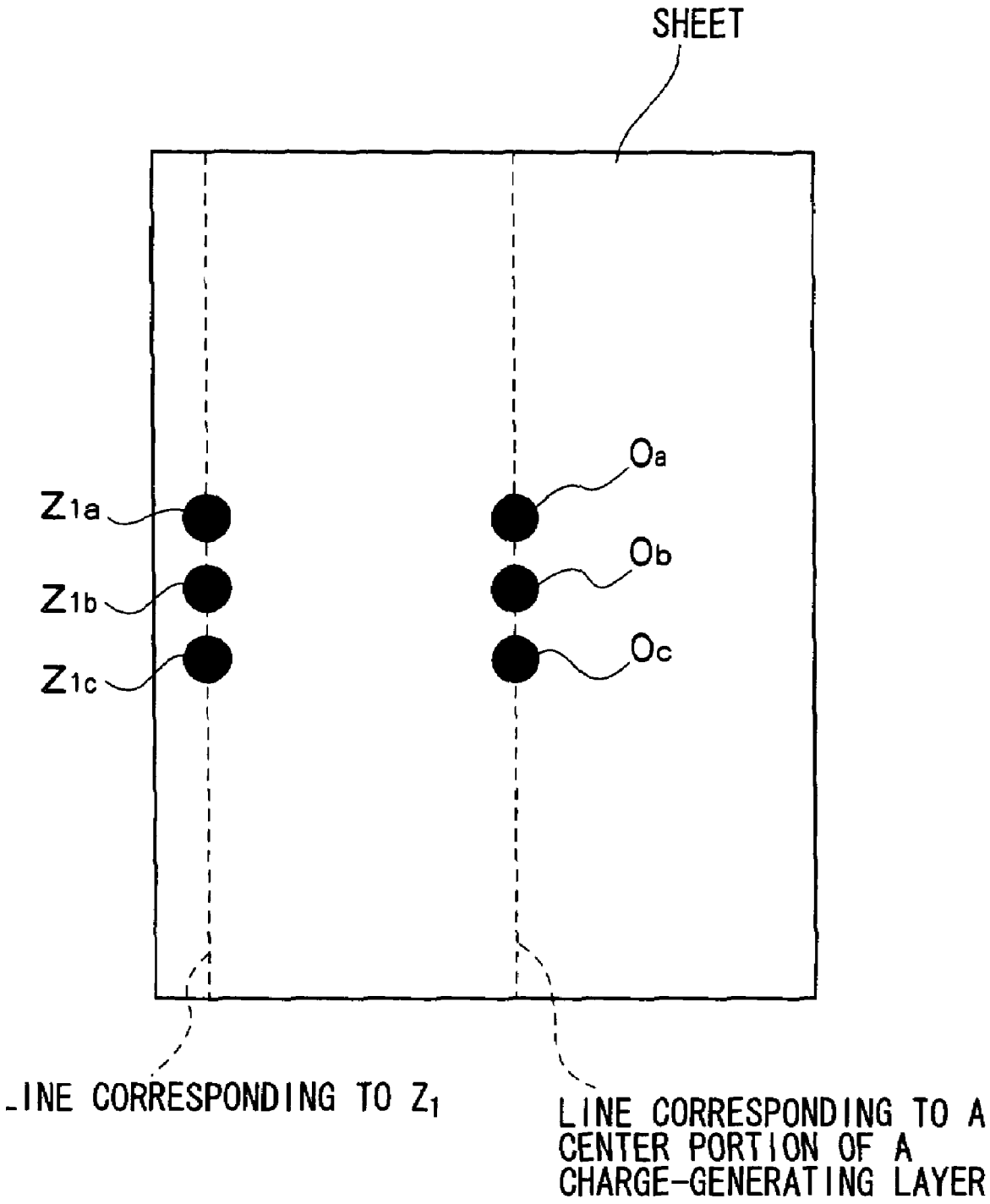
FIG. 22 is a diagram for describing measurement positions of image density unevenness in an example.

A photoreceptor in DOCUPRINT C1616 manufactured by Fuji Xerox is replaced by each of photoreceptor-1 to photoreceptor-6, and in an atmosphere of 20° C. and 50% RH, A4 paper is set such that long side of the paper passes through $Y_1$ in FIG. 18, and five images of 100% density are printed in a range of 210 mm from $Y_1$ (the range corresponds to the full width of A4 paper). In the fifth paper with the resulting image, as shown in FIG. 22, the image densities ($DZ_{1a}$, $DZ_{1b}$, $DZ_{1c}$) of arbitrary 3 points ($Z_{1a}$, $Z_{1b}$, $Z_{1c}$) in the vicinity of the center on a line (line corresponding to $Z_1$) passing through $Z_1$ and extending in the direction of the long side, and the image densities ($DO_a$, $DO_b$, $DO_c$) of arbitrary 3 points ($O_a$, $O_b$, $O_c$) in the vicinity of the center on a line (line corresponding to the central portion of the charge generating layer) passing through the central portion in the axial direction of the charge-generating layer and extending in the direction of the long side are measured to evaluate image density unevenness. The image density is evaluated in terms of the difference (unit: D) in average image density among the respective positions, that is, $[(DZ_{1a}+DZ_{1b}+DZ_{1c})/3-(DO_a+DO_b+DO_c)/3]$, by using a reflectance spectroscopic densitomer (X-Rite 938 manufactured by X-Rite).

The results are shown in Tables 3 and 4.

(Ghost)

An image formation test of 100 sheets is carried out under an environment of high temperature and high humidity (20° C. and 50% RH), with a photoreceptor replaced with one of the photoreceptors 1 through 5, in a DOCUPRINT C1616 (trade name, produced by Fuji Xerox Co., Ltd.), thereby the ghost is evaluated.

Figure 23A:
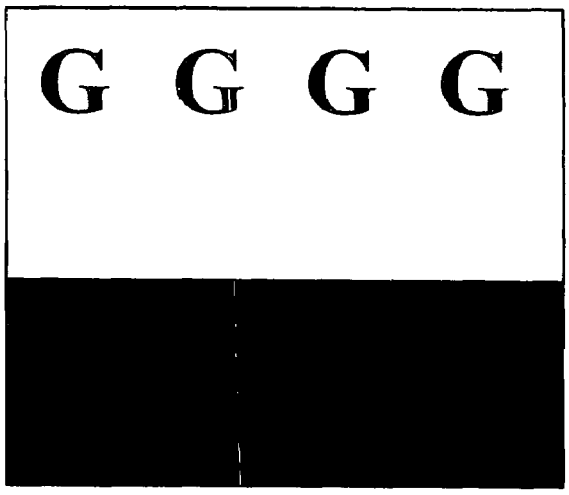
FIGS. 23A through 23C are diagrams each showing a chart for evaluating the ghost in an example.
Figure 23B:
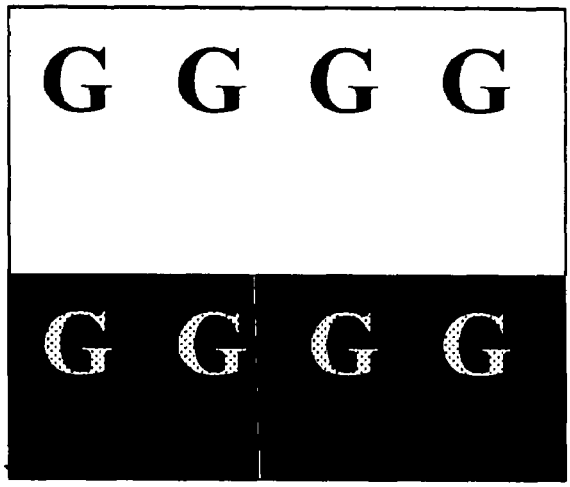
Figure 23C:
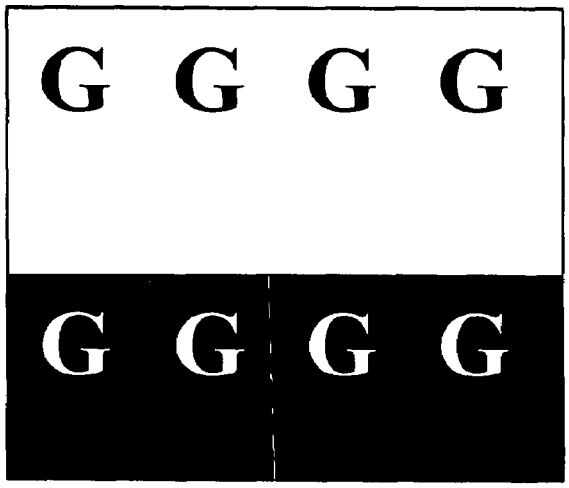

In the evaluation of the ghost, a 100% output image pattern and a chart of character [G] are printed and, as shown in FIGS. 23A through 23C, a situation where the character [G] appears in the 100% output image portion is observed and evaluated as follows. That is, three criteria below are adopted.

A: Ghost is not observed, or negligible.

B: Ghost is somewhat observed.

C: Ghost is conspicuously observed.

Results are shown in Tables 3 and 4.

(Effective Area)

Assuming that an area having an image density unevenness of 0.25D or less is regarded as an effective region, the ratio of a length of an effective region to the length of the axial direction of the cylindrical support is calculated. In this case a length of an effective region is determined by subtracting, from a length of the base material, an area not satisfying the above standard as length not utilized in image formation.

TABLE 2

| | | | Example 1 | | Example 2 | | Example 3 | |
|---|---|---|---|---|---|---|---|---|
| Charge-generating layer coating solution | Coating Solution | | Coating solution 1-1 | Coating solution 1-2 | Coating solution 2-1 | Coating solution 2-2 | Coating solution 3-1 | Coating solution 3-2 |
| | P/B ratio | | 2 | 1 | 2 | 1 | 4 | 2 |
| | Solid content | (wt %) | 7.5 | 5 | 11.5 | 5 | 3.75 | 2.5 |
| | Viscosity | (mPa · s) | 6.2 | 5 | 18.1 | 5.0 | 3.8 | 3.0 |
| Head | Kind | | Piezo intermittent type (Pixel Jet 64 by Trident) | Piezo intermittent type (MJ510C by Epson) | Piezo intermittent type (Pixel Jet 64 by Trident) | Piezo intermittent type (MJ510C by Epson) | Piezo intermittent type (Pixel Jet 64 by Trident) | Piezo intermittent type (MJ510C by Epson) |
| | Number of nozzles used | (pieces) | 20 | 64 | 20 | 64 | 20 | 64 |
| | Average frequency | (kHz) | 1.8 | 4.8 | 1.3 | 5.1 | 1.8 | 4.8 |
| | Tilt angle | (°) | 78 | 81 | 84 | 84 | 78 | 81 |
| Coating conditions | Scanning speed in an axial direction | (mm/min) | 540 | | 580 | | 540 | |
| | Rotation speed of a base material | (rpm) | 200 | | 150 | | 200 | |
| | Average volume of a liquid drop | (pl) | Ca. 50 | Ca. 8 | Ca. 50 | Ca. 8 | Ca. 50 | Ca. 8 |

TABLE 3

| | | | Example 1 | Example 2 | Example 3 |
|---|---|---|---|---|---|
| Evaluation result | Average thickness of a charge-generating layer | (μm) | 0.27 | 0.27 | 0.14 |
| | Thicknesses at the respective positions with respect to an average thickness of a charge-generating layer | (%) | 99-102 | 96-104 | 95-105 |
| | Spectral absorption ratio at the end portion (average value of both end portions), with respect to spectral absorption ratio at the center portion | (%) | 79.3 | 83.6 | 78.1 |
| | Difference in sensitivity between both end portions ΔVL1 | (V) | 3.5 | 4.5 | 4.1 |
| | Image density unevenness | (unit D) | 0.1 | 0.15 | 0.15 |
| | Ghost | | A | A | A |
| | Effective region | (%) | 98.4 | 98.4 | 98.4 |

TABLE 4

| | | | Comparative example 1 | Comparative example 2 |
|---|---|---|---|---|
| Charge-generating layer Coating Solution | Coating solution | | Coating solution 1-2 | Coating solution 1-2 |
| | P/B Ratio | | 1 | 1 |
| | Solid concentration | (wt %) | 5 | 5 |
| | Viscosity | (mPa · s) | 5.0 | 5.0 |
| Head | Kind | | Dip coating method (constant velocity) | Dip coating method (variable velocity) |
| | Number of nozzles used | (pieces) | | |
| | Average frequency | (kHz) | | |
| | Tilt angle θ | (°) | | |
| Coating conditions | Scanning speed in an axial direction | (mm/min) | 225 | 228 |
| | Rotation speed of base material | (rpm) | — | — |
| | Average volume of liquid drop | (pl) | — | — |
| Evaluation results | Average thickness of a charge-generating layer | (μm) | 0.3 | 0.3 |
| | Thicknesses at the respective positions with respect to an average thickness of a charge-generating layer | (%) | 88-105 | 87-106 |
| | Spectral absorption ratio at the end portion (average value of both end portions), with respect to spectral absorption ratio at the center portion | (%) | 129 | 135 |
| | Difference in sensitivity between both end portions ΔVL1 | (V) | 19.63 | 14.9 |
| | Image density unevenness | (Unit D) | 0.65 | 0.6 |
| | Ghost | | C | C |
| | Effective region | (%) | 88.9 | 88.9 |

In Table 4, "—" means that the item is applied.

Figure 19C:
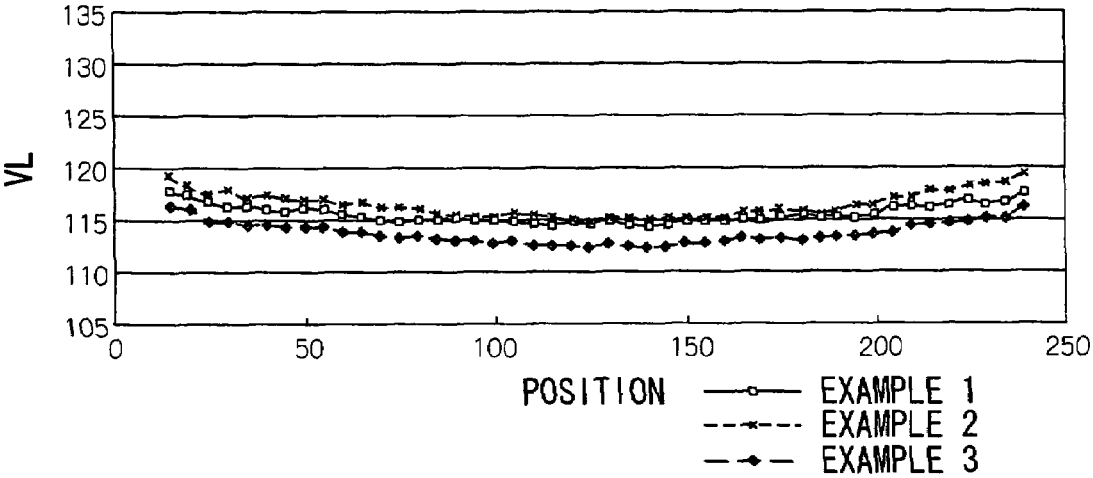
FIG. 19C is a graph showing the sensitivity distribution of a photoreceptor obtained in the Examples.

It is found that, comparing FIGS. 19B and 19C, the sensitivity varies as the spectral absorption ratio varies, while comparing FIGS. 20B and 20C, the sensitivity varies more than a variation of the spectral absorption ratio instead of obediently varying with the spectral absorption ratio, particularly in a second half in the range of 180 to 240 mm of coating. This is considered due to influence of a solvent caused by dip coating. Accordingly, in comparative examples 1 and 2 where the dip coating method is applied, factors other than the spectral absorption ratio have to be considered when the sensitivity is controlled; accordingly, a troublesome operation is necessary to control the sensitivity.

Other examples of exemplary embodiments of the present invention will be shown below.

In the method of producing the above-described electrophotographic photoreceptor, which is described in any one of claims 1 through 5 including: preparing, at least two kinds of charge-generating layer coating solutions of which content ratios of a charge-generating material with regard to a resin are different; forming, on a cylindrical support, a charge-generating layer in which a content per unit volume of a charge-generating material in the charge-generating layer increases from a center portion in an axial direction of the cylindrical support towards both end portions thereof and thicknesses of the charge-generating layer along the axial direction of the cylindrical support are within a range of from 95% to 105% with regard to an average thickness of the charge-generating layer, by controlling a discharge amount of the charge-generating layer coating solutions in an axial direction of the cylindrical support; and forming a charge-transporting layer on the charge-generating layer;

(a) the film thickness unevenness in the outer periphery of the cylindrical support may be suppressed by using, as the droplet discharge head, a cylindrical droplet discharge head arranged in the outer periphery of the cylindrical support, (b) high-speed coating may be feasible by allowing the droplet discharge head to have width equal to or greater than the length in the axial direction of the cylindrical support, and (c) a charge-generating layer coating solution of high viscosity may be applied by using, as the droplet discharge head, a continuous droplet discharge head for continuously pressurizing the charge-generating layer coating solution.

The foregoing description of the exemplary embodiments of the present invention has been provided for the purposes of illustration and description. It is not intended to be exhaustive or to limit the present invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor having a cylindrical support, and a charge-generating layer and a charge-transporting layer on the cylindrical support, a content per unit volume of a charge-generating material in the charge-generating layer increasing from a center portion in an axial direction of the cylindrical support towards both end portions thereof, and thicknesses of the charge-generating layer along the axial direction of the cylindrical support being within a range of from 95% to 105% with regard to an average thickness of the charge-generating layer.

2. The electrophotographic photoreceptor according to claim 1, wherein a spectral absorption ratio decreases from the center portion towards both of the end portions.

3. The electrophotographic photoreceptor according to claim 2, wherein the spectral absorption ratios at both of the end portions are from 75% to 99% with regard to the spectral absorption ratio at the center portion.

4. The electrophotographic photoreceptor according to claim 1, wherein a thickness of the charge-generating layer is from 0.1 μm to 0.5 μm.

5. The electrophotographic photoreceptor according to claim 1, wherein a ratio of a length of an effective region with respect to a length of the cylindrical support in the axial direction is 92% or more.

6. A process cartridge, comprising:

the electrophotographic photoreceptor according to claim 1; and at least one of a charger that charges the electrophotographic photoreceptor, a latent image formation unit that forms a latent image on the charged electrophotographic photoreceptor, a developer that develops the latent image with a toner, or a cleaner that cleans a surface of the developed electrophotographic photoreceptor.

7. An image-forming apparatus, comprising:

the electrophotographic photoreceptor according to claim 1;

a charger that charges the electrophotographic photoreceptor;

a latent image formation unit that forms a latent image on the charged electrophotographic photoreceptor;

a developer that develops the latent image with a toner; and a transfer unit that transfers the toner image onto a recording medium.

8. A method of producing an electrophotographic photoreceptor, comprising:

preparing, at least two kinds of charge-generating layer coating solutions of which content ratios of a charge-generating material with regard to a resin are different;

forming, on a cylindrical support, a charge-generating layer in which a content per unit volume of a charge-generating material in the charge-generating layer increases from a center portion in an axial direction of the cylindrical support towards both end portions thereof and thicknesses of the charge-generating layer along the axial direction of the cylindrical support are within a range of from 95% to 105% with regard to an average thickness of the charge-generating layer, by controlling a discharge amount of the charge-generating layer coating solutions in an axial direction of the cylindrical support; and forming a charge-transporting layer on the charge-generating layer.

9. The method of producing an electrophotographic photoreceptor according to claim 8, wherein an inkjet method is used to discharge the charge-generating layer coating solutions from a droplet discharge head.

10. The method of producing an electrophotographic photoreceptor according to claim 9, wherein the inkjet method is a method that uses a piezoelectric element.

11. The method of producing an electrophotographic photoreceptor according to claim 9, wherein the viscosities of the charge-generating layer coating solutions are from 0.8 mPa·s to 20 mPa·s.

12. The method of producing an electrophotographic photoreceptor according to claim 9, wherein a plurality of the droplet discharge heads is disposed.

13. The method of producing an electrophotographic photoreceptor according to claim 9, wherein the droplet discharge head has a cylindrical shape and is disposed so as to surround the cylindrical support.

14. The method of producing an electrophotographic photoreceptor according to claim 9, wherein a width of the droplet discharge head is equal to or longer than a length of the cylindrical support in an axial direction thereof.

15. The method of producing an electrophotographic photoreceptor according to claim 9, wherein the droplet discharge head is a continuous droplet discharge head that continuously pressurizes the charge-generating layer coating solution.

* * * * *